US006661995B2

(12) United States Patent
Isobe et al.

(10) Patent No.: US 6,661,995 B2
(45) Date of Patent: Dec. 9, 2003

(54) SHEET PROCESSING APPARATUS AND IMAGE FORMING APPARATUS PROVIDED WITH THE SAME

(75) Inventors: Kenichiro Isobe, Shizuoka (JP); Yasuyoshi Hayakawa, Shizuoka (JP); Takashi Kuwata, Shizuoka (JP); Masayoshi Fukatsu, Shizuoka (JP); Junichi Sekiyama, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/225,300

(22) Filed: Aug. 22, 2002

(65) Prior Publication Data

US 2003/0044209 A1 Mar. 6, 2003

(30) Foreign Application Priority Data

Aug. 31, 2001 (JP) ..... 2001-265111
Feb. 26, 2002 (JP) ..... 2002-050378

(51) Int. Cl.[7] ..... B65H 37/04; G03G 15/00
(52) U.S. Cl. ..... 399/410; 270/37; 399/110
(58) Field of Search ..... 399/407, 408, 399/410, 107, 110, 124, 21; 270/37, 58.08

(56) References Cited

U.S. PATENT DOCUMENTS

| | | | | |
|---|---|---|---|---|
| 4,281,920 A | * | 8/1981 | Cross | 270/37 X |
| 6,092,712 A | * | 7/2000 | Rueckl | 270/37 X |
| 6,206,369 B1 | | 3/2001 | Hoshii et al. | 271/290 |
| 6,302,606 B1 | | 10/2001 | Hayakawa et al. | 400/625 |
| 6,318,718 B1 | | 11/2001 | Ogata et al. | 271/213 |
| 6,325,371 B1 | | 12/2001 | Araki et al. | 271/297 |
| 6,382,616 B1 | | 5/2002 | Waragai et al. | 270/58.12 |

FOREIGN PATENT DOCUMENTS

| | | |
|---|---|---|
| JP | 09-183560 | * 7/1997 |
| JP | 2001-010764 | * 1/2001 |
| JP | 2001-302080 | * 10/2001 |

* cited by examiner

*Primary Examiner*—Sophia S. Chen
(74) *Attorney, Agent, or Firm*—Fitzpatrick, Cella, Harper & Scinto

(57) ABSTRACT

A cover for forming an outer appearance of a stapler unit for performing a stapling process to a sheet bundle serves also as a part of an outer shell of an apparatus body, and the stapler unit is provided selectively to the apparatus body movably between a position for stapling the sheet bundle and a position for replacing staple cartridges, to thereby make it possible to readily perform a jam process or staple replacement.

14 Claims, 24 Drawing Sheets

SHEET PROCESSING APPARATUS AND IMAGE FORMING APPARATUS PROVIDED WITH THE SAME

BACKGROUND OF THE INVENTION

1. Field of the Invention

The present invention relates to a sheet processing apparatus in which jam processing or staple replacement is easy and cost may be reduced and an image forming apparatus provided with this. Also, the invention relates to a sheet processing apparatus in which stapler means may readily be removed and an image forming apparatus provided with this. In particular, the present invention relates to means for performing a stapling process to sheets on which an image has been formed.

2. Related Background Art

In some cases, a conventional image forming apparatus such as a copying machine, a printer and a facsimile machine is provided with a sheet processing apparatus for picking up sheets on which an image has been formed one by one and a stapling process is performed to the sheets in order to reduce time and labor to be needed for stapling the sheets such as pieces of copying paper on which an image has been formed.

There is known a type of such a sheet processing apparatus, which is provided on a side surface of the sheet discharge port side of the image forming apparatus body, aligns the sheets that were printed in the image forming apparatus before being fed from the discharge port, thereafter performs the stapling process, and discharges the sheets.

Also, in general, a stapling mechanism section for performing the above stapling process is located in an interior of an outer shell of the sheet processing apparatus. Such a type is known in which, in the case where the jam processing or the staple replacement is to be performed in the stapling mechanism section, an outer shell lid is opened and the jam processing or the staple replacement is performed.

However, in the sheet processing apparatus having the stapling function, since the stapling mechanism is arranged in the interior of the outer shell of the sheet processing apparatus, the user has to perform the jam processing or the staple replacement by actually opening the outer shell lid upon the jam processing or the staple replacement in the stapler section.

Also, in the sheet processing apparatus having such a staple function, since the stapler is fixed by screws to the interior of the outer shell of the sheet processing apparatus, it is necessary to remove the stapler after removal of the screws by opening the outer shell lid upon the stapler replacement or, depending upon the situation, even in the case of the jam processing or the staple replacement.

For this reason, a large number of time and labor are required by the user upon the jam processing or the staple replacement and the manipulation property is inferior due to the processing in the interior of the outer shell. Also, since the lid is provided on the outer shell, the structure is complicated to increase the cost, disadvantageously.

SUMMARY OF THE INVENTION

Accordingly, in view of the above-described situation, an object of the present invention is to provide a sheet processing apparatus in which the jam processing or the staple replacement is easy and the cost therefor may be reduced and an image forming apparatus provided with the sheet processing apparatus.

Also, an object of the present invention is to provide a sheet processing apparatus in which a stapler (stapler means) may be removed with ease and an image forming apparatus provided with the sheet processing apparatus.

According to the present invention, there is provided a sheet processing apparatus provided with stapler means for performing a stapling process to a sheet bundle, characterized in that the stapler means comprises a detachably mountable staple cartridge, and a cover that forms an outer appearance of the stapler means and serving also as an outer shell of the sheet processing apparatus, and the stapler means is provided in an apparatus body selectively movably between a stapling position for stapling the sheet bundle and a position for replacing the staple cartridge.

Further, according to the present invention, there is provided a sheet processing apparatus provided with stapler means for performing a stapling process to a sheet bundle, characterized in that the stapler means is detachably mounted on the apparatus body and provided movably to a position where the stapler means is removable.

Further, the present invention is characterized in that the stapler means is held with a constant force in each position of the position for stapling the sheet bundle and the position for replacing the staple cartridge.

Further, the present invention is characterized in that the stapler means is held with a constant force in the position for stapling the sheet bundle.

Further, the present invention is characterized in that the stapler means is held in the two positions with a constant force when the stapler means is located in the position for stapling the sheet bundle and in the position where the stapler means is removable.

Further, the present invention is characterized in that the stapler means is provided rotatably to the apparatus body.

The present invention further comprises holding means provided in the stapler means for holding the stapler means detachably to the apparatus body, characterized in that the holding means is in the condition that the stapler means may be removed from the apparatus body when the stapler means is moved to the position where the stapler means is removable.

Further, the present invention is characterized in that the holding means is a shaft member that is engaged elastically with the apparatus body for holding the stapler means and that, when the holding means is moved to the position where the stapler means is removable, is operable to release the elastic engagement with the apparatus body and to move to the position where the stapler means is removable.

Further, the present invention is characterized in that the shaft member is provided in a position where the shaft member is not visible from the outside until the stapler means is moved to the removable position.

The present invention further comprises mounting guide means for guiding the stapler means to a predetermined held position of the apparatus body, characterized in that the holding means is a shaft for guiding the stapler means along the mounting guide section to the predetermined held position and for pivotally supporting the stapler means movably between the position for stapling the sheet bundle and the removable position in the predetermined held position and is operable to remove the stapler means along the mounting guide section from the apparatus body when the stapler means is moved to the removable position.

Further, the present invention is characterized in that a cutaway portion if formed for removing the stapler means away from the apparatus body along the mounting guide section when the stapler means is moved to the removable position.

Further, the present invention is characterized in that a jam process cover is provided and, in the case where the jam process cover is opened or in the case where the stapler means is not in the stapling position for stapling the sheet bundle, the stapler means is inoperative.

Further, the present invention is characterized in that the stapler means and the apparatus body are connected to each other through an electric cable connector, and a connector for the stapler means and a connector for the apparatus body are detachably mountable.

Further, the present invention is characterized in that the stapler means is provided with a connector connected to the connector on the side of the apparatus body and provided retractably to the apparatus body, and the stapler means is removed while drawing the connector on side of the apparatus body when the stapler means is to be removed.

The present invention is characterized by further comprising return means for returning the connector on the side of the body removed from the stapler means to the apparatus body after the stapler means has been removed.

The present invention further comprises a sheet stacking section for stacking the sheet bundle to which the stapling process is performed; and alignment means for performing alignment of the sheet stacked on the sheet stacking section, characterized in that the alignment operation is possible by the alignment means when the apparatus body side connector is removed from the stapler means that has been removed.

According to the present invention, there is provided an image forming apparatus provided with an image forming section and a sheet processing apparatus for performing stapling process to a sheet on which an image is formed by the image forming section, characterized in that the sheet processing apparatus is produced in accordance with any one of the above descriptions.

Further, the present invention is characterized in that the sheet processing apparatus is disposed above the image forming apparatus body.

The present invention further comprises a paper feed cassette received detachably in the image forming apparatus body and an operation section provided in the image forming apparatus body, characterized in that a sheet conveying direction in the stapler means of the sheet processing apparatus and any one of a mounting direction of the paper feed cassette and a direction toward the operating section are the same.

Further, the present invention is characterized in that, when the stapler means of the sheet processing apparatus is in a staple cartridge replacement position, the staple cartridge replacement direction is in a direction close to the sheet conveying direction in comparison with the position for stapling the sheet.

Further, the present invention is characterized in that the stapler means is provided with a staple cartridge removal knob for removing the staple cartridge, and that the staple cartridge removal knob is visually observable in any one of the mounting direction of the paper feed cassette and a direction toward the operating section.

The present invention is characterized by including a first sheet stacking section for stacking tentatively the sheet on which an image is formed by the image forming section and a alignment means for performing the alignment of the sheet stacked on the first sheet stacking section.

As described above, according to the present invention, the cover forming the outer appearance of the stapler means is provided to serve as a part of the outer shell of the apparatus body and the stapler means is provided in the apparatus body, movably selectively in the position where the sheet bundle is bound and the position where the staple cartridges are replaced, to thereby make it possible to facilitate the jam processing or the staple replacement and to reduce the cost.

Also, the stapler means is maintained by the holding member so as to be detachably mounted to the apparatus body and able to move between the position where the sheet bundle may be bound and the position where the bundle may be removed. On the other hand, the holding means may perform the operation for removing the stapler means from the interior of the apparatus body when the stapler means is moved to the position where the bundle means may be removed, thereby making it possible to readily remove the stapler means.

DESCRIPTION OF THE PREFERRED EMBODIMENTS

An embodiment of the present invention will now be described in detail with reference to the accompanying drawings.

Figure 1:
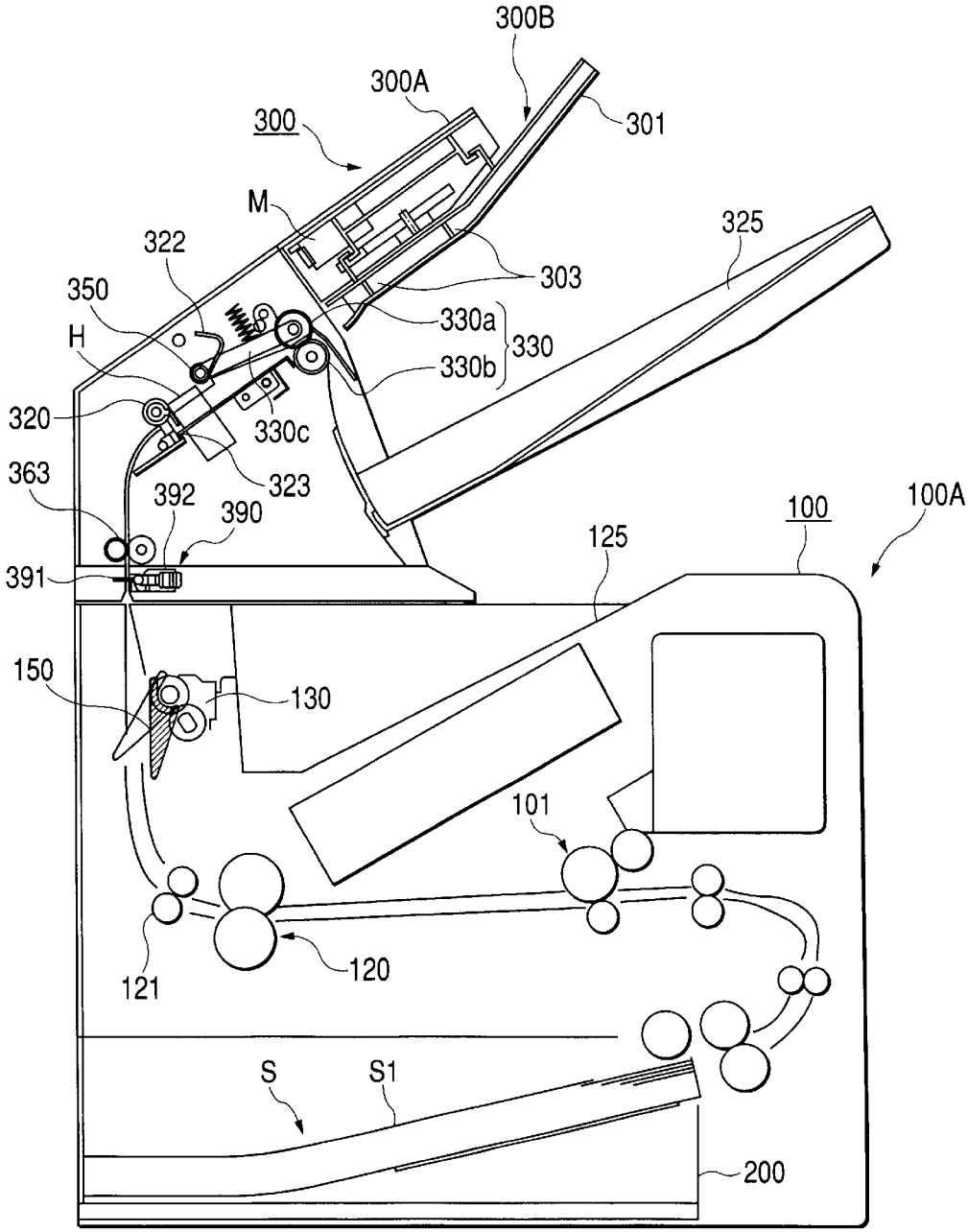
FIG. 1 is a schematic cross-sectional view showing a whole structure of a laser beam printer that is an example of an image forming apparatus provided with a sheet processing apparatus according to a first embodiment of the present invention.

FIG. 1 is a schematic cross-sectional view showing a whole structure of a laser beam printer that is an example of an image forming apparatus provided with a sheet processing apparatus according to a first embodiment of the present invention.

In FIG. 1, symbol 100A denotes a laser beam printer and reference numeral 100 denotes a laser beam printer body (hereinafter referred to as a printer body). The laser beam printer 100A is connected independently to a computer or a network such as a LAN, forms an image (print) on a sheet by a predetermined image forming process on the basis of a print signal, image information or the like fed from the computer or the network and discharges the sheet.

Also, reference numeral 300 denotes a sheet processing apparatus. This sheet processing apparatus 300 is arranged on the upper portion of the printer body 100 and is adapted to stack sheets discharged from the printer body 100 to the outside on a first stacking section 300B with their image surface in face down through a conveyer section within the sheet processing apparatus, and then align the sheets by a alignment means 301 to be described later. The sheet processing apparatus 300 bundles the sheets for every predetermined job, staples the sheets at one position or a plurality of positions, and discharges and stacks the sheets onto a second stacking section 325, or discharges and stacks the sheets simply in a face down manner onto the second stacking section 325.

In this case, the sheet processing apparatus 300 and the printer body 100 are electrically connected to each other through a cable connector (not shown). Also, the sheet processing apparatus 300 has a casing portion 300A for receiving the respective parts and is adapted to be detachably mountable to the printer body 100.

With respect to the structure of each part of the printer body 100, the conveying path of a sheet S to be delivered will now be described.

In the printer body 100, a plurality of sheets S are laid within a feeding cassette 200 so that the uppermost sheet S1 may be separated and conveyed one by one by various rollers. In the sheet S that has been conveyed from the feeding cassette 200, a toner image is transferred to a top surface in an image forming section 101 for forming a toner image by a so-called laser beam type image forming process, and subsequently heat or pressure is applied in a fixing device 120 on a downstream side in accordance with a predetermined print signal that has been fed from the computer or the network, to thereby permanently fix the toner image.

Subsequently, the sheet S on which the image has been fixed is folded back in a substantially U-shaped conveying path to discharging rollers 130 so that the image surface of the sheet S is turned over. Thus, the sheet is discharged in the face down manner from the printer body 100 under the condition that the image surface faces downwardly.

In this case, the sheet S is selected to be discharged to a face down (FD) discharging section 125 provided in an upper portion of the printer body 100 by, for example, the discharging rollers 130, or to be discharged to the second stacking section 325 of the sheet processing apparatus 300, in response to the position of a flapper 150 of the printer body 100 which rotates on the basis of a control signal from the control section (not shown).

The operation of the sheet processing apparatus 300 and each section in the case where the sheet S that has been conveyed from the sheet processing apparatus 300 and the printer body 100 is conveyed toward the sheet processing apparatus 300 will now be described with reference to FIGS. 2A, 2B, 3A and 3B.

Figure 2A:
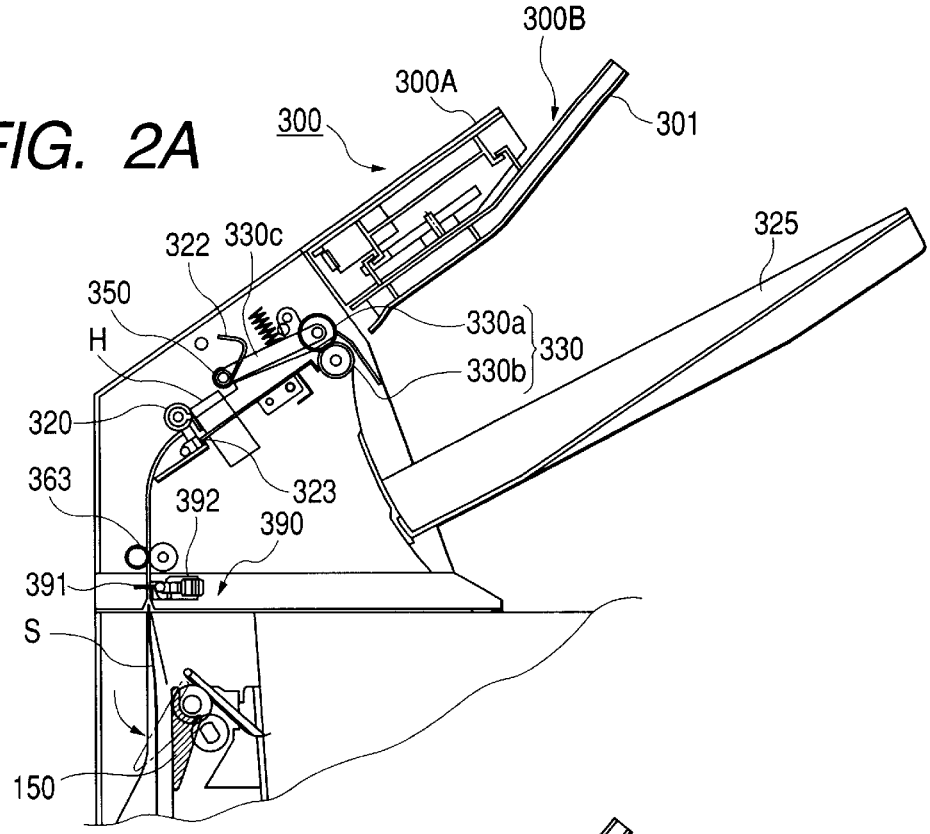
FIGS. 2A and 2B are views illustrating the structure of the sheet processing apparatus and motions of the respective parts in the case where a sheet conveyed from the printer body forwarded to the sheet processing apparatus.
Figure 2B:
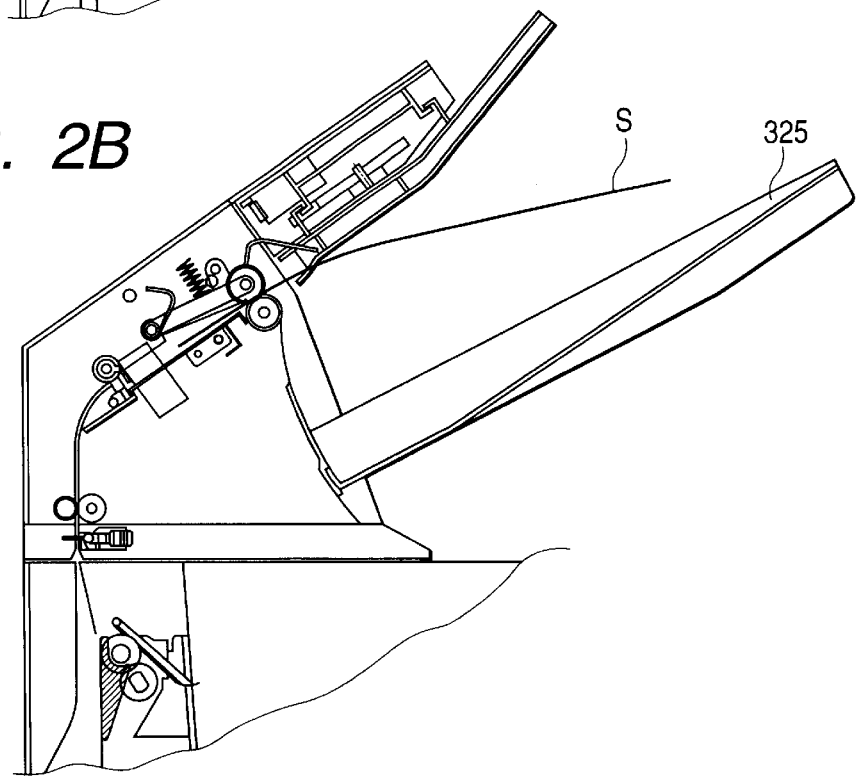

In FIGS. 2A and 2B, symbol 330*a* denotes an sheet discharging upper roller, symbol 330*b* denotes a sheet discharging lower roller, symbol M denotes a jogger motor as a drive source, reference numeral 322 denotes a paddle, and reference numeral 323 denotes a reference wall against which the sheet rear end is to be abutted. In this case, as shown in FIGS. 2A and 2B, the pair of the discharging rollers 330 composed of the sheet discharging upper roller 330*a* and the sheet discharging lower roller 330*b* is arranged on the upper side on the downstream side in the sheet conveying direction of the above-described flapper 150, and is rotatably driven by a drive motor (not shown).

Also, the sheet discharging upper roller 330*a* is pivotally supported to an arm 330*c* rotatable about a paddle shaft 350. The jogger motor M is a motor for driving each slide guide 301 and 302 to be described later. In this embodiment, a stepping motor is used as the jogger motor M.

Also, a plurality of paddles 322 are made of elastic material such as rubber and fixed to the paddle shaft 350 in a direction perpendicular to the sheet conveying direction. Then, when the sheet is discharged from the printer body 100, the paddles are rotated clockwise by the drive of the paddle shaft 350 so that the sheet S is moved in the opposite direction to the sheet conveying direction to be brought into contact with and aligned with the reference wall 323.

Figure 3A:
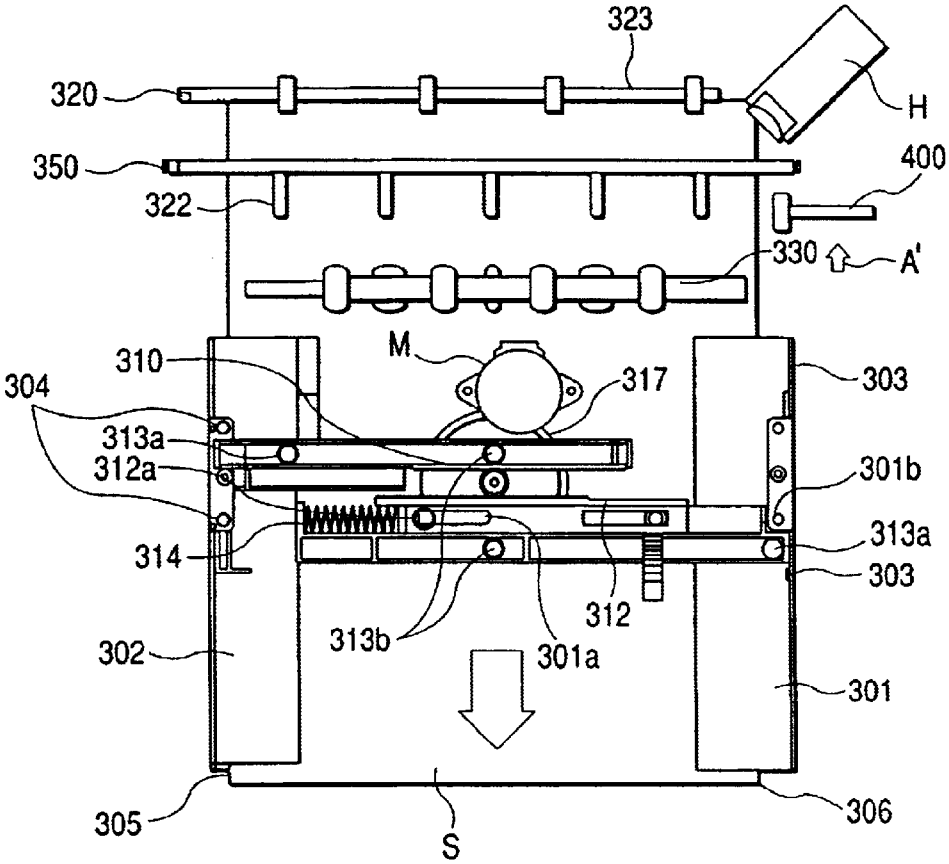
FIGS. 3A and 3B are a plan view and a side elevational view of a primary part of the sheet processing apparatus.
Figure 3B:
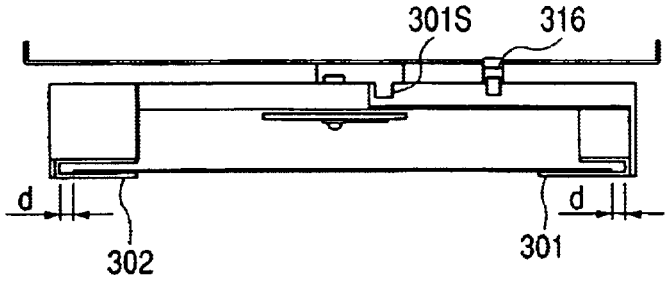

Also, as shown in FIGS. 3A and 3B, in the sheet processing apparatus 300 according to this embodiment, the slide guide 301 and the slide guide 302 to be described in detail later are provided as alignment members for performing the alignment in a width direction of the sheet. Also, in FIGS. 3A and 3B, symbol H denotes a stapler that is a stapler means for stapling the sheet bundle thereby performing the stapling process to the sheet bundle, and the stapler H is arranged and fixed on the side of the slide guide 301 for performing the stapling at the upper left corner portion of the image surface of the sheet on which the image has been formed, thereby stapling each sheet.

Then, the sheet processing apparatus 300 with such a structure is adapted to perform the staple process on the basis of a command outputted from a computer or the like. In the case where such a staple process is to be performed, first of all, the flapper 150 is rotated in the counterclockwise direction by a solenoid (not shown) as shown in FIG. 2A before the sheet to be stapled is discharged by convey rollers 121 provided in the printer body 100, so that the sheet path is switched over to the side of the sheet processing apparatus.

Thus, the sheet S is conveyed to the sheet processing apparatus 300 by means of the convey rollers 121. Then, the sheet S that has been thus conveyed to the sheet processing apparatus 300 causes a flag 391 of an inlet sensor 390 to rotate clockwise so that the flag 391 causes the light to pass through a photo sensor 392 to thereby detect the passage of the sheet S. Thereafter, the sheet S is conveyed upwardly by means of a pair of inlet rollers 363.

By the way, in this embodiment, this sheet processing apparatus 300 is adapted to discharge and stack the sheets onto the second stacking section 325 after stapling and also discharge and stack the sheets onto the second stacking section 325 simply in a face down manner.

The operation for discharging and stacking the sheet onto the second stacking section 325 in the face down manner will now be described.

Figure 4A:
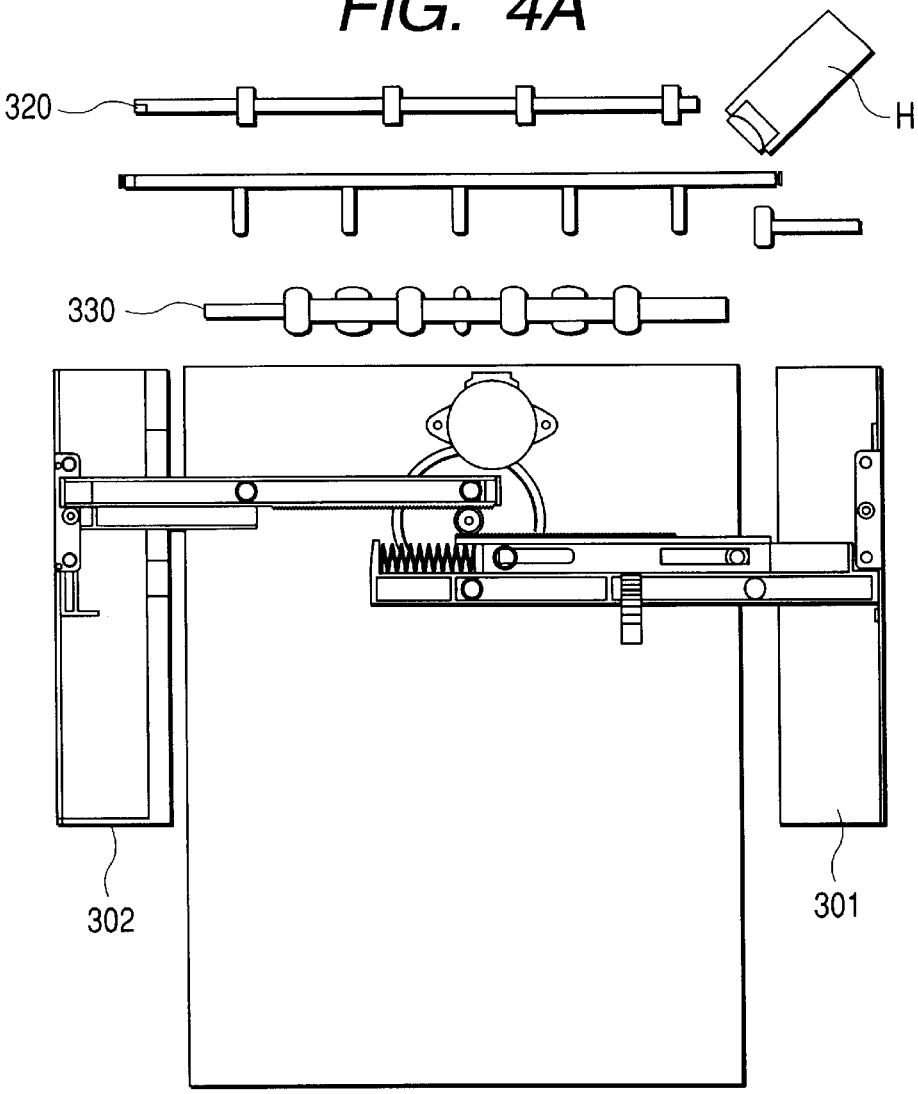
FIGS. 4A and 4B are views showing a condition that the sheet bundle falls down when a slide guide provided in the sheet processing apparatus is located in a home position.

In this case, as shown in FIG. 4A, the bottom surfaces of the slide guide 302 on the left side and the slide guide 301 on the right side to the sheet conveying direction are retracted to positions where the bottom surfaces are not brought into contact with the sheet S to be conveyed, i.e., outside positions deviated by a predetermined amount from the widthwise direction of the sheet S so as not to support the sheet S.

Figure 4B:
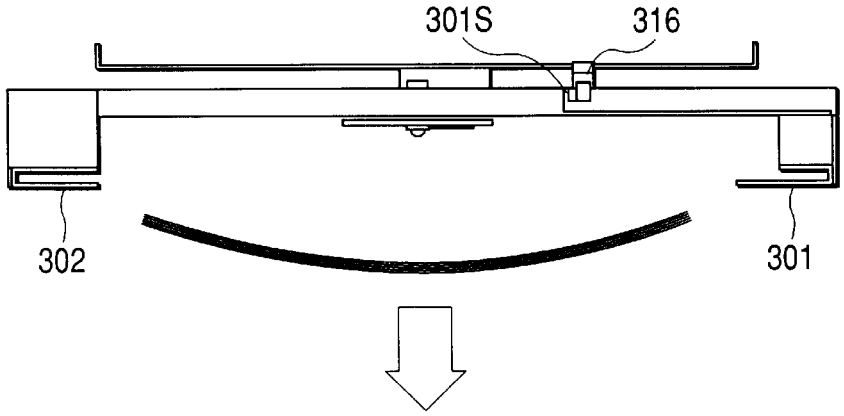

Accordingly, the sheet that has been conveyed by the pair of inlet rollers 363 is passed through the pair of the staple rollers 320, thereafter conveyed by means of the pair of sheet discharging rollers 330 through an opening of the stapler H, and dropped toward the second sheet discharge section 325 as shown by an arrow of FIG. 4B and shown in FIG. 2B.

The operation for discharging and stacking the sheet onto the second stacking section 325 after stapling will now be described.

In this case, in the slide guides 301 and 302, reference pins 303 and 304 provided on the wall surfaces of the slide guides 301 and 302 are retracted to positions so as not to interfere with the sheet S to be conveyed as shown in FIG. 3A.

Also, in this case, the slide guides 301 and 302 are located in such a position that an interval of end surfaces of the bottom surfaces thereof is smaller than a width of the sheet S, and the two slide guides 301 and 302 are located in such a position so that the first stacking section 300B for supporting the sheet S to be introduced may be formed.

Accordingly, the sheet that has been conveyed by the pair of inlet rollers 363 is passed through the pair of staple rollers 320, thereafter conveyed by the pair of sheet discharging rollers 330 through the opening of the stapler H, and conveyed onto the guide surface of the first sheet stacking section 300B constituted by the slide guides 301 and 302.

Figure 5A:
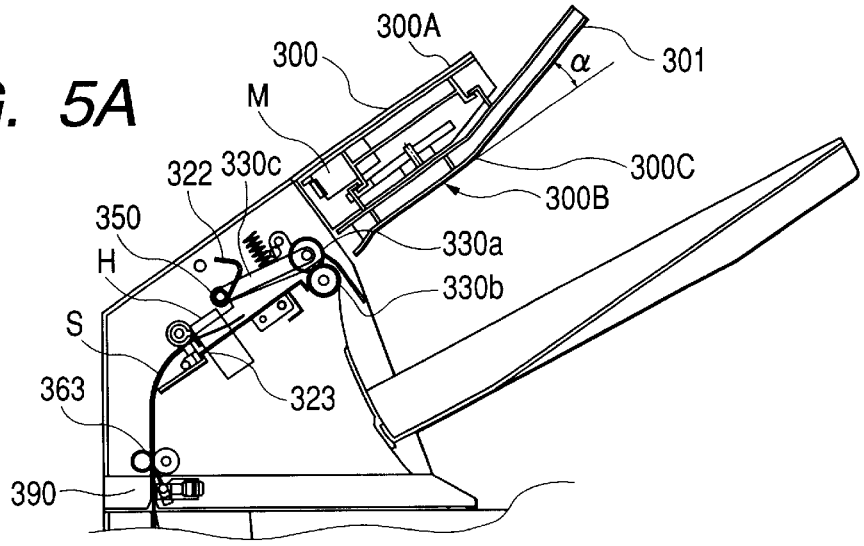
FIGS. 5A, 5B and 5C are views illustrating motions of the respective parts in a stapling operation of the sheet processing apparatus.

In this case, as shown in FIG. 5A, the guide surface of the first sheet stacking section 300B is slanted at a predetermined angle to the horizontal direction to form slant angles which are different between an upstream side and the downstream side in the sheet conveying direction. More specifically, a bent portion 300C that is bent at a slant angle $\alpha$ between a predetermined region on the upstream side and a predetermined region on the downstream side is formed. Incidentally, there is provided such a bent portion 300C to thereby prevent the flexure of the central portion of the sheet S that is not guided by the respective slide guides 301 and 302.

Figure 5B:
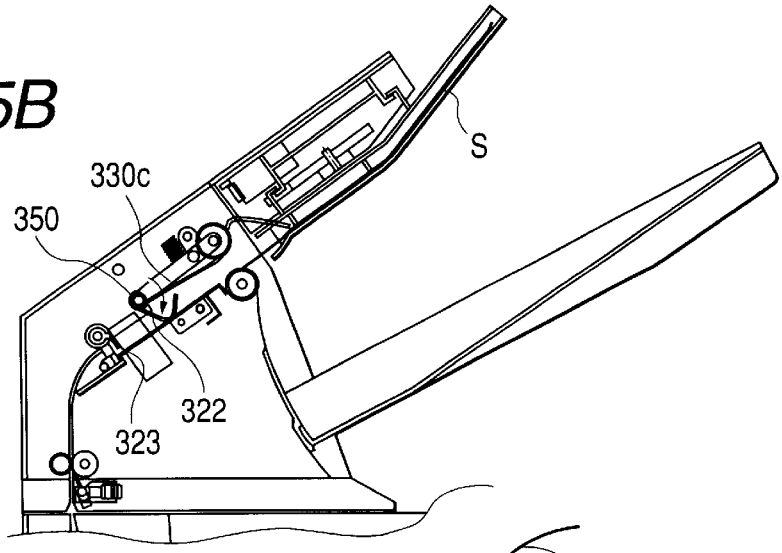

On the other hand, immediately after the first sheet has been thus conveyed onto the top surface defined by the slide guide 301 and 302, as shown in FIG. 5B, the arm 330*c* is rotated counterclockwise so that the sheet discharging upper roller 330*a* pivotally supported to the arm 330*c* is retracted upwardly to thereby space the pair of sheet discharging rollers.

Also, the drive connected to the pair of sheet discharging rollers 330 simultaneously therewith is interrupted and the rotation of the sheet discharging upper roller 330*a* and the sheet discharging lower roller 330*b* is stopped. As a result, when the rear end of the sheet S is completely passed through the pair of staple rollers 320, the sheet S is returned back in the opposite direction to the conveying direction by the gravitational force and is moved in the direction toward the reference wall 323.

Subsequently, only the slide guide 302 on the left side is operated, the alignment operation in the width direction of the sheet S laid on the first sheet stacking section 300B is started. More specifically, the slide guide 302 is driven by the motor M and is moved to the right side of FIGS. 3A and 3B so that the reference pins 304 provided in the slide guide 302 are brought into contact with the left side surface of the sheet S to thereby push the sheet S on the side of the slide guide 301.

Then, the right side surface of the sheets is brought into abutment with the reference pins 303 provided in the slide guide 301 to thereby perform the alignment in the widthwise direction of the sheet. The sheet S is set so that the sheet S is in contact with the reference pins 303 and brought into the staple position set in the aligned position. After the alignment, the slide guide 302 is moved in a direction of expanding wider than a width of the sheet S so as to be ready to convey the next sheet in the waiting position again.

The structures of the slide guides 301 and 302 will now be described in detail.

As is shown in FIGS. 3A and 3B, each slide guide 301, 302 is guided by four guide pins, which are guide pins guide pins 313*a* provided in a mold frame and 313*b* provided on a plate frame, so as to be reciprocatingly movable in right and left directions of FIGS. 3A and 3B, i.e., a direction (width direction) perpendicular to the sheet conveying direction and at the same time to be moved by the drive force from the jogger motor M.

Also, each slide guide 301 and 302 exhibits a U-shaped form in cross-section by each guide wall section for guiding both sides of the sheet S and support sections for supporting the top and bottom surfaces of the sheet S as shown in FIG. 3B as viewed from the downstream side in the sheet conveying direction. Each sheet to be discharged onto the first sheet stacking section 300B by the lower surface of the U-shape is supported and the central portion in the widthwise direction of the sheet S is not supported.

Furthermore, a slide rack section 310 having a spur gear that is engaged with a stepped gear 317 is provided on the slide guide 302. A slide rack 312 having a spur gear that is engaged with the stepped gear 317 is also mounted on the slide guide 301.

In this case, the slide rack 312 is provided to be movable relatively to the slide guide 301 through a coil spring 314. Incidentally, this spring 314 is brought into contact with the slide guide 302 at one end side and brought into contact with the slide rack 312 at the other end side so that the slide guide 301 and the slide rack 312 are biased in a direction of expansion. Also, the slide rack 312 has an angular hole portion 312*a* for moving an emboss portion 301*a* to the side of the slide guide 301.

Furthermore, the two reference pins 303 made of metal that is superior in anti-wear property are provided on the side wall of the slide guide 301 and the two reference pins 304 are provided on the side wall of the slide guide 302, respectively. When the sheet is aligned, as described above, the slide guide 302 is moved so that the reference pins 304 and 303 are brought into contact with both side end surfaces 305 and 306 of the sheet.

Also, the slide guides 301 and the slide guide 302 are supported in a height direction by the stepped gear 317 and the jog plate frame F.

The operation of each slide guide 301 and 302 will now be described.

When the power source is turned on for the sheet processing apparatus 300, the pair of staple rollers 320 starts to rotate, and subsequently, the jogger motor M rotates to rotate the stepped gear 317 so that the slide rack section 310 of the slide guide 302 is driven to retract to the outside.

Also, with respect to the slide guide 301, when the jogger motor M rotates and the stepped gear 317 rotates, first of all, the slide rack 312 is moved relatively, and the angular hole portion 312*a* of the slide rack 312 is brought into contact with the right side end surface of the emboss portion 301*a* of the slide guide 301 shown in FIGS. 3A and 3B. Thereafter, the slide guide 301 is depressed by the angular hole portion 312*a* and retracted to the outside.

A slit portion 301S is provided in the slide guide 301. When the slit portion 301S is moved through a predetermined retracted distance, as shown in FIG. 4B, the photo sensor 316 receives light. At this time, the jogger motor M stops. This position will be hereinafter referred to as a "home position".

On the other hand, when a signal for introducing the sheet S into the sheet processing apparatus 300 is inputted from the printer body 100, the jogger motor M rotates so that the slide guides 301 and 302 are moved inwardly and stop in the position where the width between the slide guides is greater by a predetermined amount d than the width of the sheet S to be introduced as shown in FIGS. 3A and 3B. In this position, the stopper 301*b* is in contact with the guide pin 313*a* so that the slide guide 301 could not be moved further inwardly. This position will be hereinafter referred to as a "waiting position". Incidentally, in the waiting position, the side surface of the slide guide 301 becomes the reference position of the alignment operation.

In this embodiment, in the case where the size (width) of the sheet S is the maximum size of the sheet that may pass through, the waiting positions of the slide guides 301 and 302 are set so that the gaps on both sides have the predetermined amounts d, d.

Incidentally, in the case where the sheet having a narrower width than that of the above-described sheet is to be aligned in alignment, the slide guide 302 is moved rightward corresponding to this, so that the gap on the left side in the waiting position shown in FIGS. 3A and 3B is always kept at the predetermined amount d. On the other hand, in this case, the gap between the sheet and the slide guide 302 is expanded by half the amount that becomes narrower by the predetermined amount d.

Figure 6A:
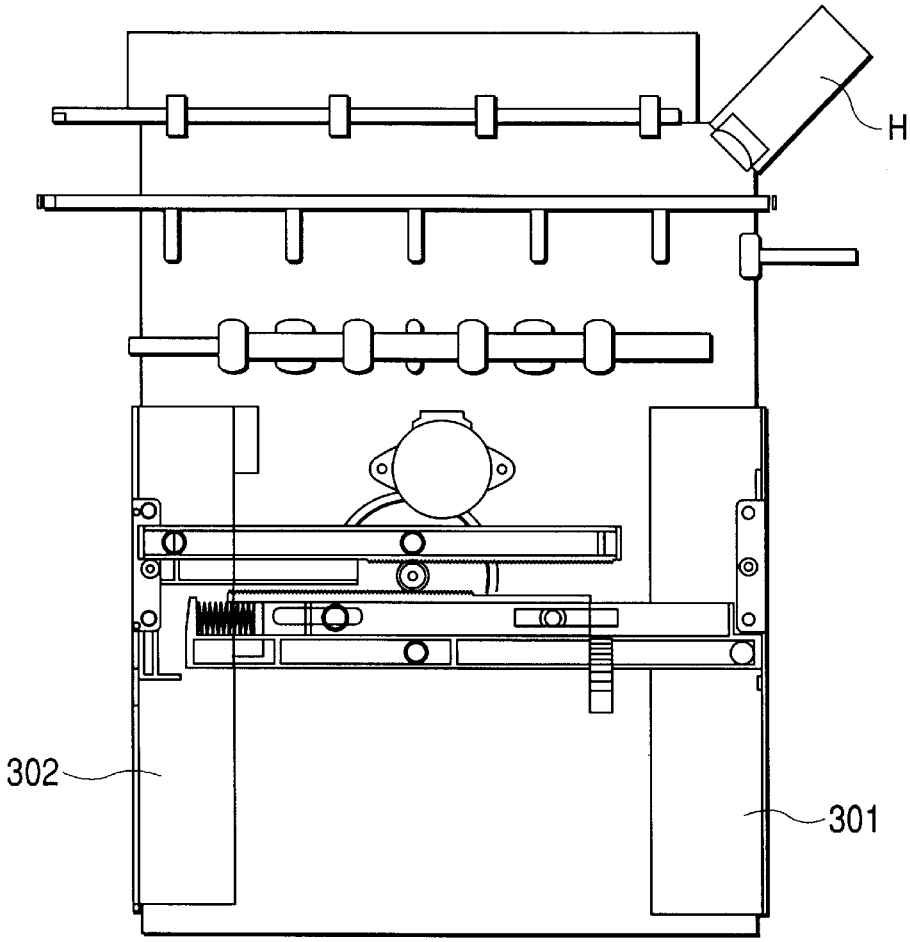
FIGS. 6A and 6B are views showing a condition where the sheets are aligned by the slide guide.
Figure 6B:
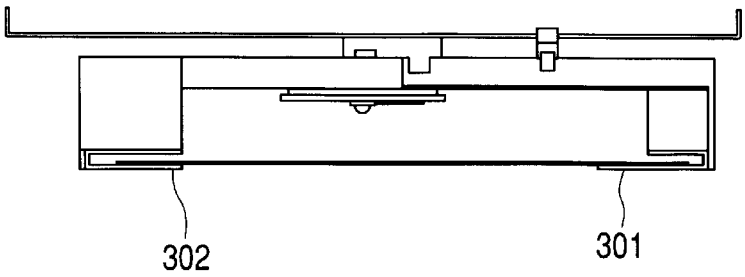

On the other hand, as shown in FIGS. 6A and 6B, after the completion of the alignment in the widthwise direction by the slide guides 301 and 302, both slide guides 301 and 302 are retracted somewhat outwardly so that the limit in the alignment direction of the sheet S is kept rough and the sheet S may be moved in the sheet conveying direction. Thereafter, as shown in FIG. 5B, the paddles 322 are rotated clockwise about the paddle shaft 350 through one turn in contact with the top surface of the sheet S whereby the sheet S is brought into contact with the reference wall 323 for alignment.

Figure 7A:
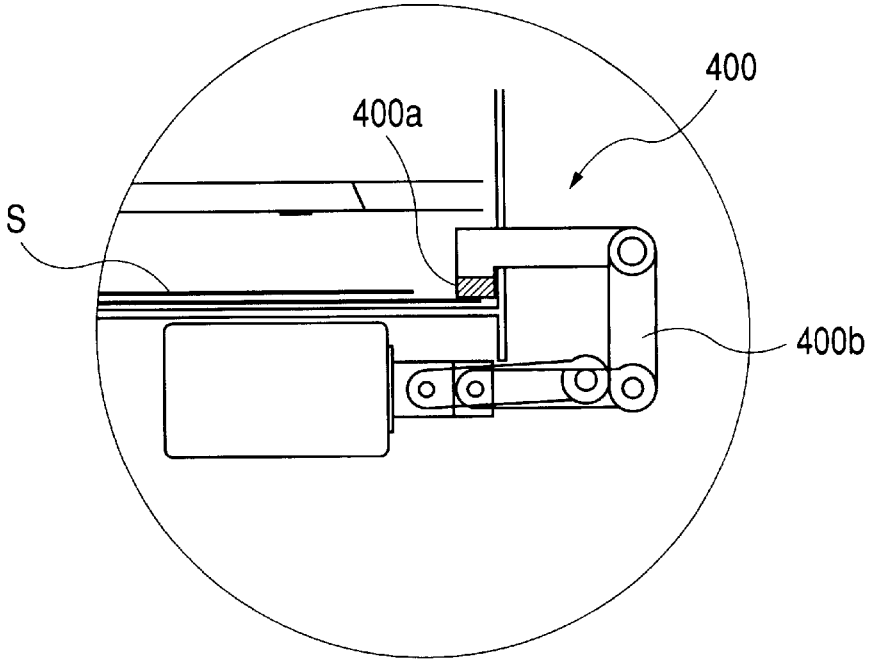
FIGS. 7A and 7B are views as viewed in a direction shown by an arrow A of FIG. 3A.
Figure 7B:
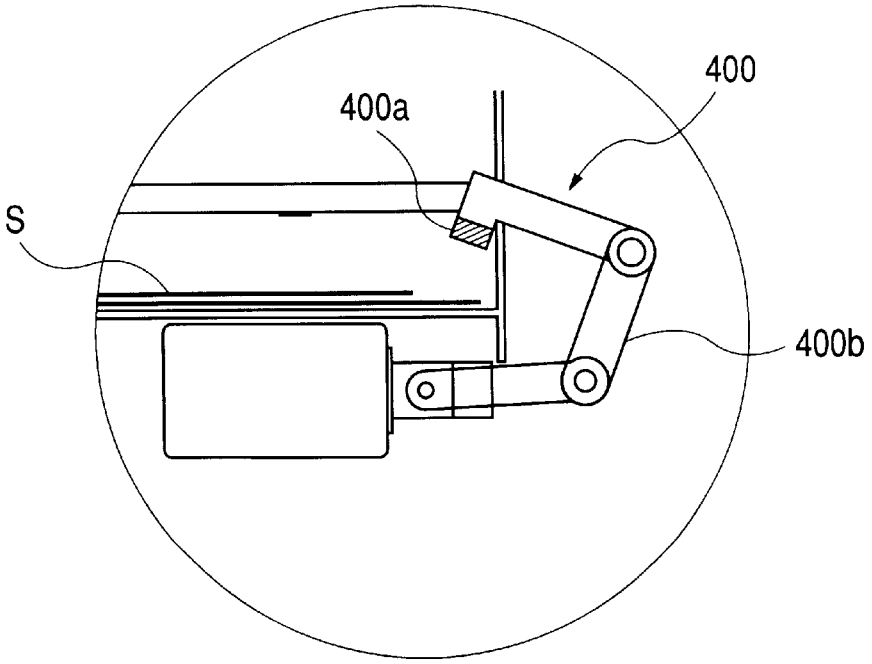

Then, with such an operation, the alignment in the sheet conveying direction and the widthwise direction is possible. Incidentally, in order to keep such aligned condition, stamp means 400 for depressing the sheet S aligned by moving up and down a lever 400*b* provided with a frictional member 400*a* as shown in FIGS. 7A and 7B that are views as viewed in a direction indicated by an arrows A' of FIG. 3A is provided in the vicinity of the right end surface of the sheet kept aligned as shown in FIGS. 6A and 6B.

In this case, the stamp means 400 is provided with the lever 400*b* that rotates in the up and down direction. After the completion of the alignment operation, the lever 400*b* that has been rotated upwardly as shown in FIG. 7B is rotated downwardly and pushes the top surface of the sheet as shown in FIG. 7A before the sheet to be introduced next is brought into contact with the aligned sheet, whereby the aligned sheet is moved by the next sheet to thereby prevent the alignment from falling into disorder.

Incidentally, after the completion of the alignment of the first sheet in this manner, the second sheet is conveyed. However, in this case, since the pair of discharging rollers 330 are separated during the conveyance of the second sheet and the following sheets, when the trailing end of the sheet S is completely passed through the pair of staple rollers 320, the sheet is returned back in the opposite direction by its gravitational force and moved toward the reference wall 323. Incidentally, the alignment operation onward is the same as that of the first sheet and the explanation therefor will be omitted.

Then, such an operation is repeated. The operation for aligning the last (n-th) sheet (Sn) of one job is performed. Each reference pin 304 provided in the slide guide 302 causes the left side surface of the sheet to come into contact with each reference pin 303 of the slide guide 301. Under the condition in FIGS. 6A and 6B in which the movement of the slide guide 302 is stopped, the position on the right trailing end is stapled by the miniaturized stapler H located in the right trailing end of the sheet bundle.

In this case, with such a structure and such an operation, the slide guide 301 is stopped in the reference position and not moved during the alignment operation of each sheet and only the slide guide 302 is moved so that the left side end portion of each sheet is aligned in the reference position. Accordingly, the stapling process by the stapler H arranged and fixed on the side of the slide guide 301 may be performed positively and accurately.

Furthermore, even if there is non-uniformity in width of each sheet to be conveyed in one job or the sheet size within one job is changed, for example, from LTR to A4, since the position of the left end portion of each sheet is aligned to be constant, the finishing of the stapling process by the stapler H is correct and neat to ensure the excellent effect.

Figure 5C:
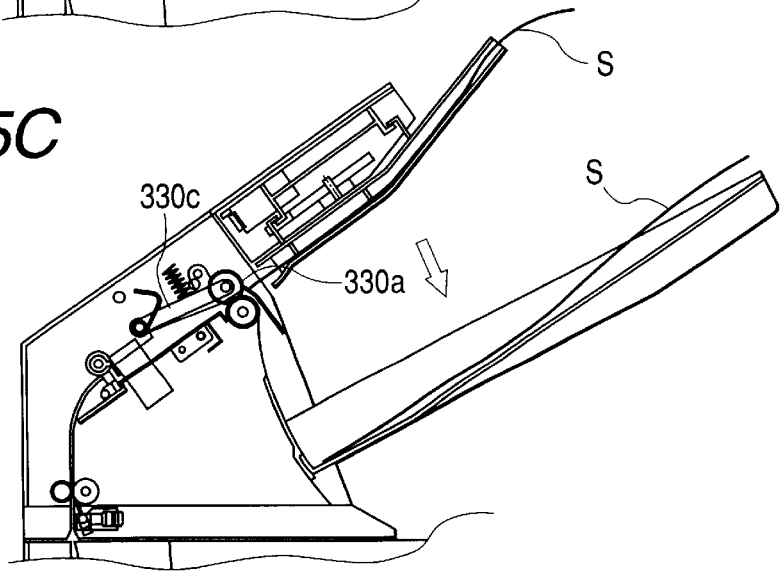

On the other hand, when the staple operation is thus completed, as shown in FIG. 5C, the arm 330*c* is rotated clockwise so that the sheet discharging upper roller 330*a* pivotally supported to the arm 330*c* is moved downwardly to form the pair of the sheet discharging rollers 330, and at the same time to drive the pair of sheet discharging rollers 330 to start the rotation of the sheet discharging upper roller 330*a* and the sheet discharging lower roller 330*b*. Thus, the sheet bundle S is clamped by the pair of sheet discharging rollers 330 and is conveyed onto the first stacking section 300B formed by the slide guides 301 and 302.

Then, thereafter, when the sheet bundle S is completely discharged from the pair of sheet discharging rollers 330, the jogger motor M is drivingly rotated so that the slide guide 302 is moved in an expanding direction from the condition shown in FIGS. 6A and 6B. Incidentally, upon the start of movement of the slide guide 302, on the side of the slide guide 301, the slide rack 312 is moved to the right side of FIGS. 6A and 6B and the slide guide 301 per se is not immediately moved.

Then, when the position of the slide guide 302 has passed through the waiting position shown in FIGS. 3A and 3B, the emboss portion 312*a* of the slide rack 312 is brought into contact with the end surface of the angular hole portion 310*a* of the slide guide 301, the slide guide 301 starts to move to the right side of FIGS. 3A and 3B and both the slide guides 301 and 302 move.

Furthermore, thereafter, when the distance between the two slide guides 301 and 302 becomes close to the width of the sheet or wider than the width, the sheet bundle that has been subjected to the stapling and that is supported to the slide guides 301 and 302 falls downwardly as shown in FIG. 5C to be stacked on the second stacking section 325. The structure of the printer body and the sheet processing apparatus according to this embodiment and a series of the operation thereof have been described above.

The structure of the stapler H located in the right trailing end of the sheet bundle will now be described.

Figure 8:
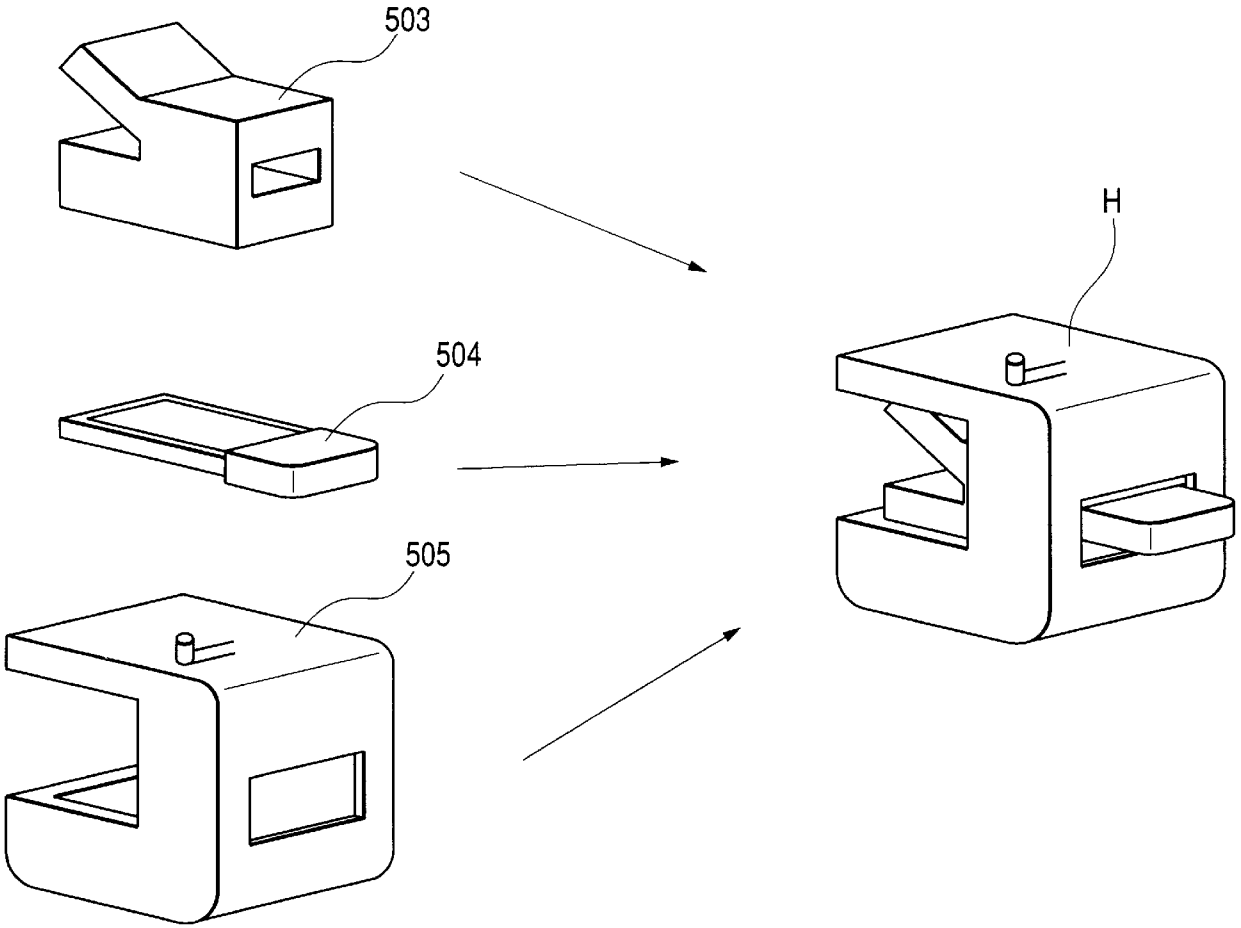
FIG. 8 is a view showing a structure of a stapler provided in the sheet processing apparatus.

As shown in FIG. 8, the stapler H according to this embodiment is composed of a stapler body 503, a staple cartridge 504, and a staple cover 505 that is a cover forming an outer appearance of the stapler H.

Figure 9:
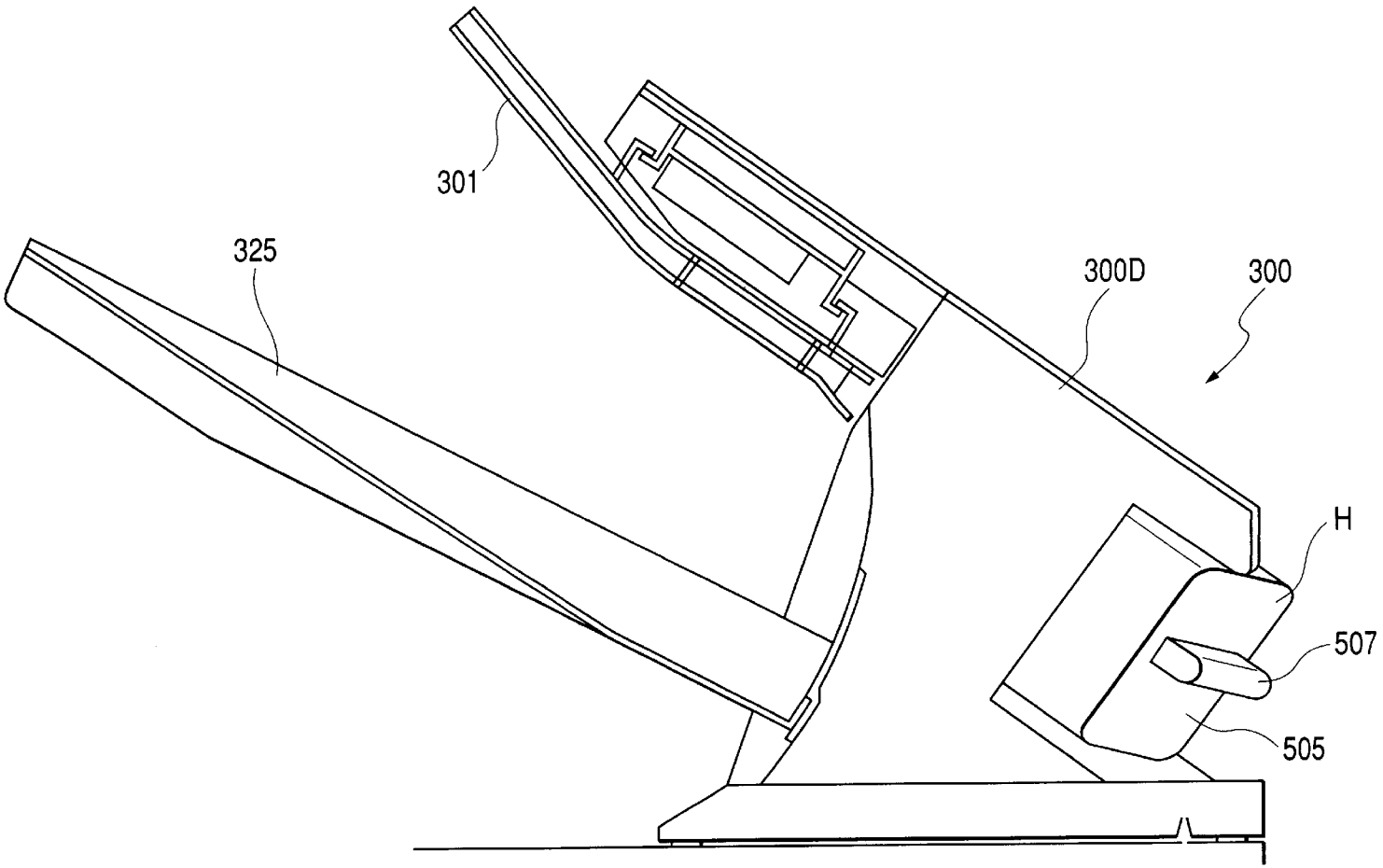
FIG. 9 is a side elevational view of the sheet processing apparatus.

Incidentally, FIG. 9 is a right side elevational view of the sheet processing apparatus 300. As shown in FIG. 9, the staple cover 505 has a structure also serving as an outer shell of the sheet processing apparatus body 300D.

Then, thus, the staple cover 505 serves also as the outer shell of the sheet processing apparatus body 300D whereby it is unnecessary to perform the jam process or the staple replacement by actually opening the outer shell lid during the jam process or the staple replacement in the stapler section to thereby make it possible to enhance the operationability and to reduce time and labor. Also, since it is unnecessary to provide the lid on the outer shell, the structure becomes simple and the cost therefor may be reduced.

Incidentally, in FIG. 9, reference numeral 507 is a staple cartridge removal knob. When the staple cartridge 504 is replaced, the staple cartridge 504 is replaced after the staple cartridge removal knob 507 is drawn out.

Figure 10A:
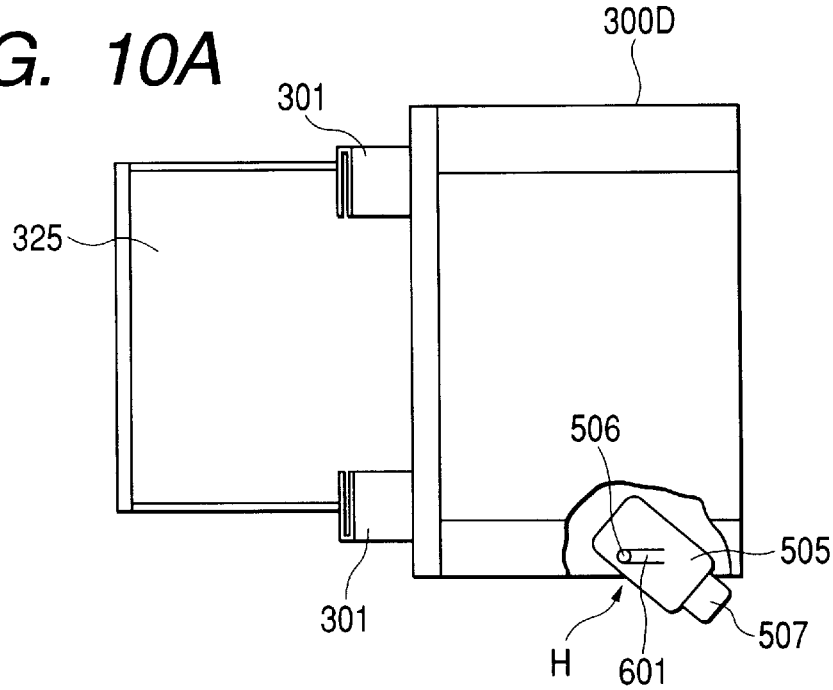
FIGS. 10A and 10B are views showing a staple operational position of the stapler and a rotational position thereof.

Also, the stapler H is provided rotatably (movably) about the shaft 506 in the sheet processing apparatus body 300D as shown in FIG. 10A. Namely, the stapler H may be moved selectively between the staple operating position shown in FIG. 10A and the rotational position shown in FIG. 10B and may be maintained in each position by a latch mechanism (not shown) in a click-sensing manner.

Figure 11:
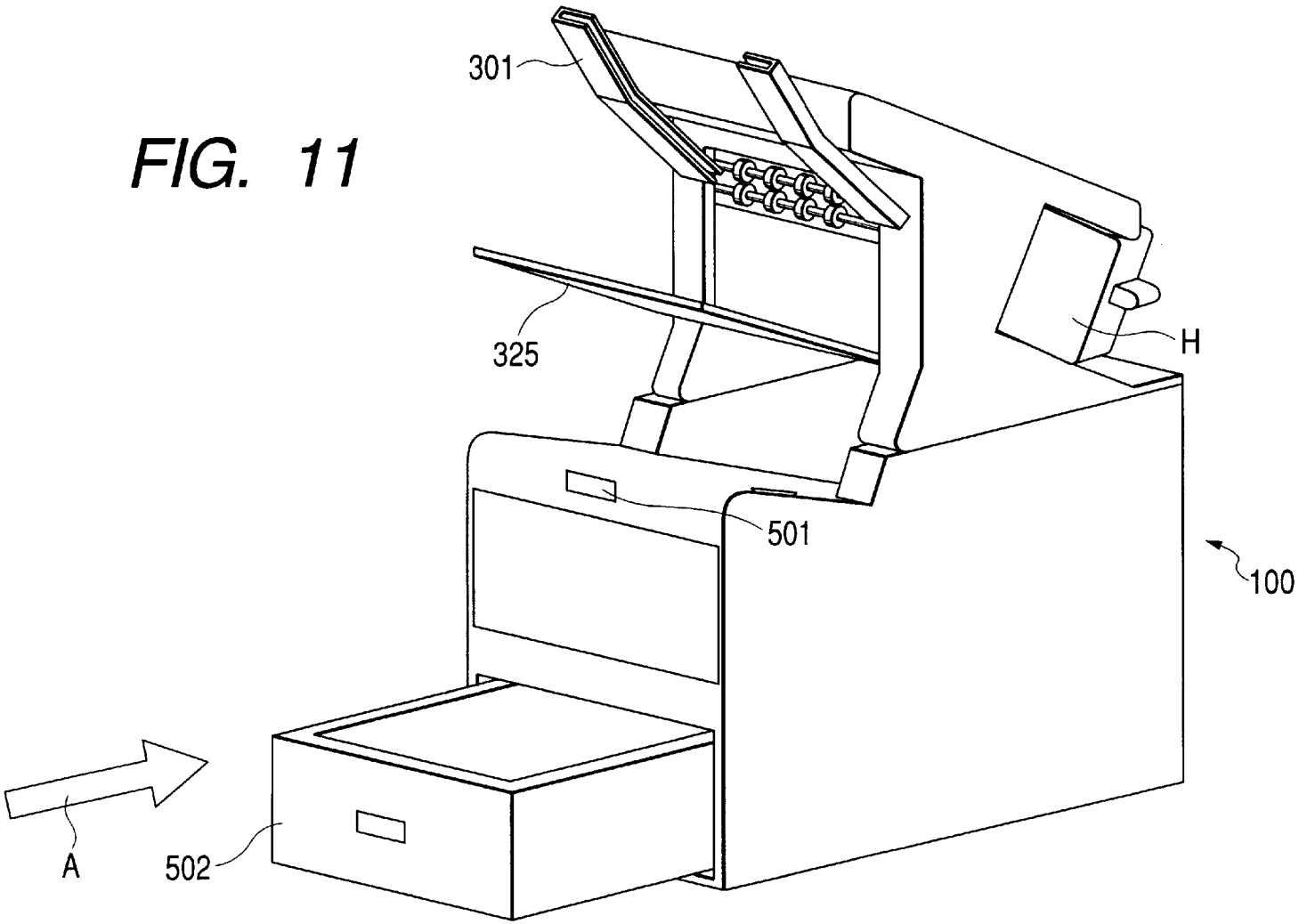
FIG. 11 is a perspective view showing a user access direction to the sheet processing apparatus.

In this case, the user access direction of the printer body 100 and the sheet processing apparatus 300 according to this embodiment is a direction indicated by the arrow A of FIG. 11 in the direction toward the operation panel 501 that is the operational section of the printer body 100 and in the direction for removing the sheet feeding cassette 502 detachably mounted on the printer body 100.

Figure 10B:
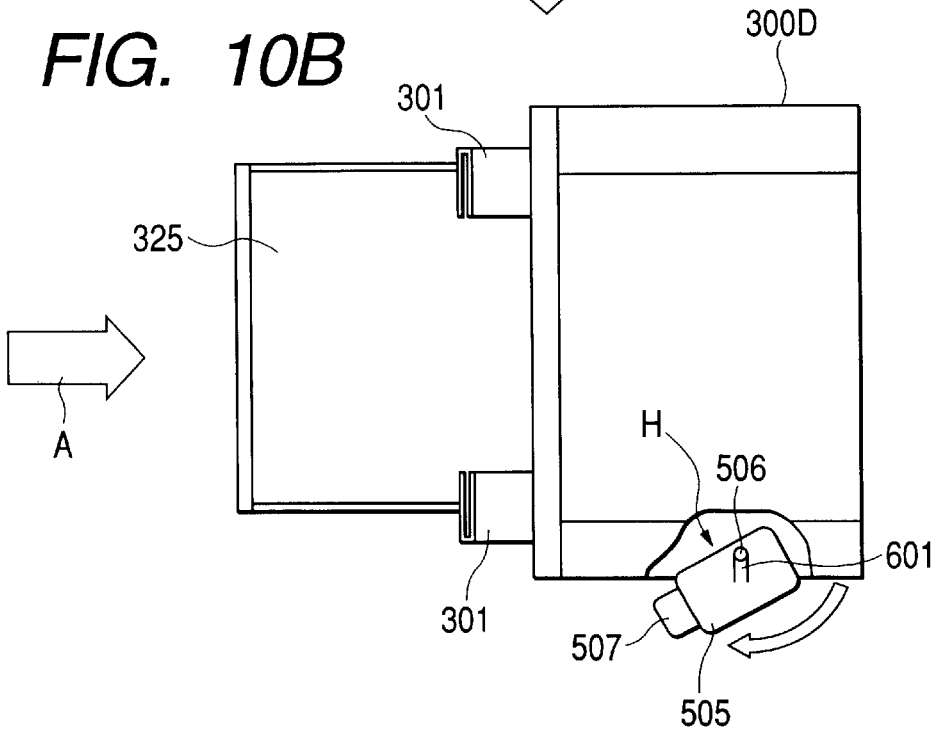

Then, the position of the staple cartridge removal knob 507 in the rotational position of FIG. 10B is a position close to the direction indicated by the arrow A that is the user access direction of the sheet processing apparatus 300 in accordance with this embodiment to the position in the staple operating position shown in FIG. 10A. Incidentally, since the staple cartridge removal knob 507 is visually observable in either direction of a direction toward the operation panel 501 shown in FIG. 11 and the removal direction of the paper feed cassette 502, the operation is facilitated.

The jam process in the stapler section of the sheet processing apparatus 300 with such a structure and the operation by the user when the staples of the stapler are expended will now be described.

Figure 12A:
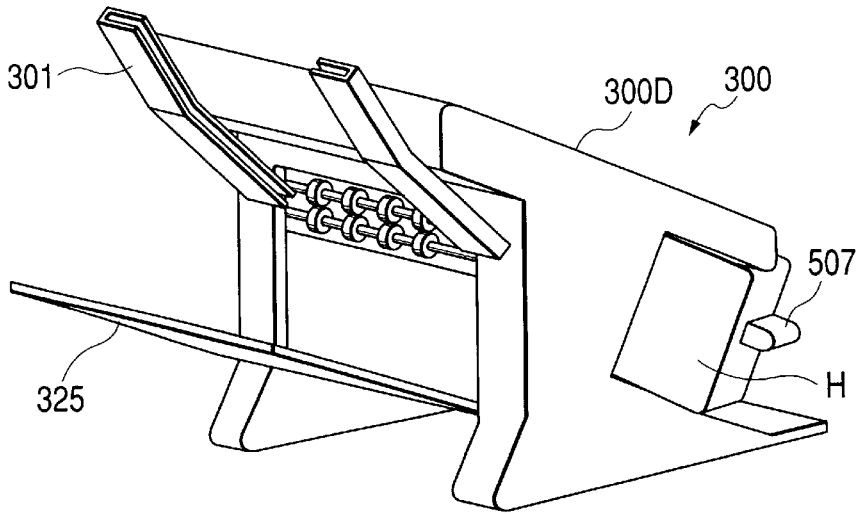
FIGS. 12A and 12B are views showing the rotational operation of the stapler.
Figure 12B:
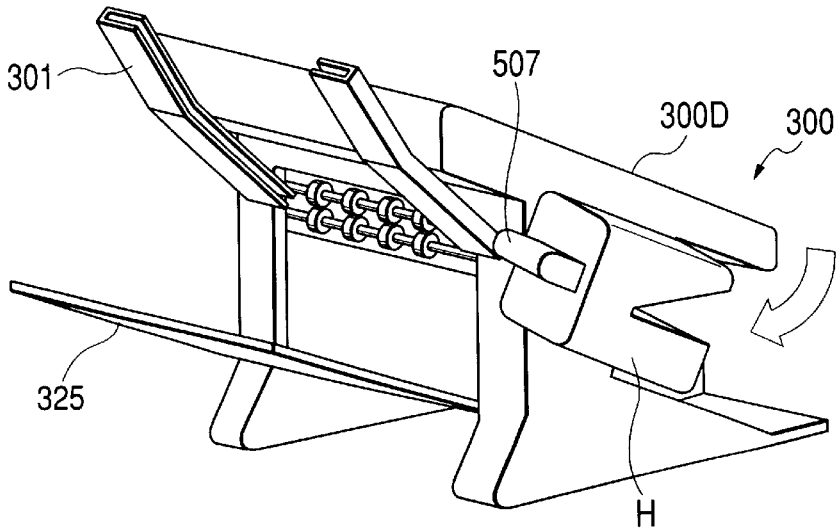

When the staples of the stapler H have been expended, the user rotates the stapler H located in the staple operating position shown in FIG. 12A about the shaft 506 directly manually from the user access side as shown in FIGS. 12A and 12B, and moves the stapler H to the rotational position shown in FIG. 12B.

Incidentally, although the stapler H is held in the staple operating position with a constant force by the latch mechanism (not shown) when the stapler H is in the staple operating position, the holding force of the latch mechanism is released when the stapler H is rotated manually and moved from the staple operating position. On the other hand, thereafter, when the stapler H is rotated to the rotational position, the stapler is again held with a constant force in a click-sensing manner by the latch mechanism (not shown).

In this case, if the stapler H is moved to the rotational position, then the direction of the staple cartridge removal knob 507 is directed close to the user access side to the staple operating position.

Accordingly, the user may easily draw out the staple cartridge removal knob 507 and replace the staple cartridges, as a result of which it is possible to enhance the operationability during the staple replacement.

Figure 13:
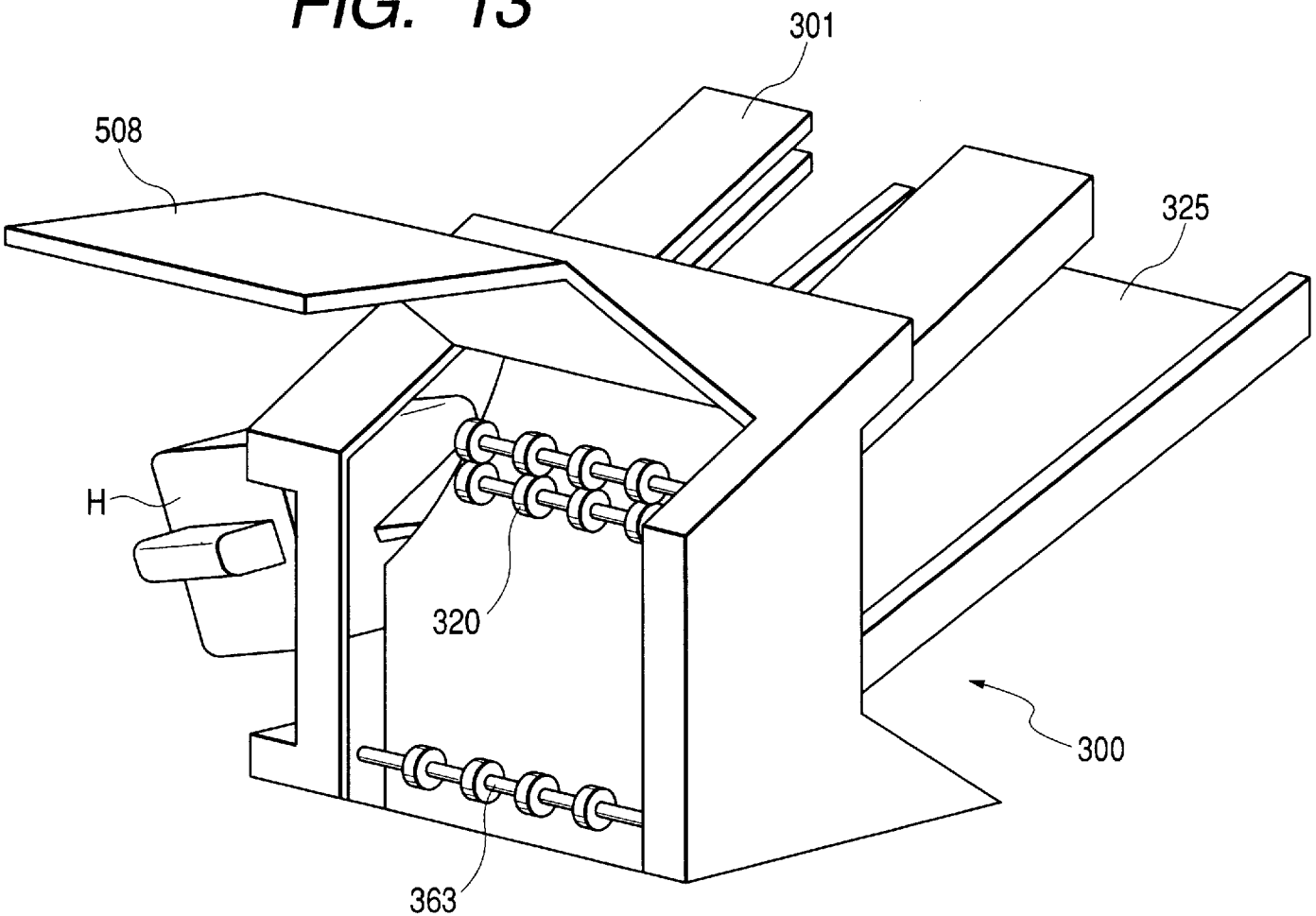
FIG. 13 is a perspective view showing a condition that a jam processing cover provided on the sheet processing apparatus is opened.

By the way, in the sheet processing apparatus 300 with such a structure, a jam processing cover 508 for jam process in the conveyer section as shown in FIG. 13 is provided. When the jam process is performed, this jam processing cover 508 is opened.

However, in the case where the staple cover 505 serves also as the outer shell of the sheet processing apparatus body 300D, when the jam processing cover 508 is thus opened, since the stapling section of the stapler H is exposed, it is desirable to disable the operation of the stapler H when the jam processing cover 508 is opened. Also, even if the stapler H is moved to the rotational position as described above, since the stapling section is exposed, it is also preferable to disable the operation of the stapler.

The operation by the user when the staple clogging occurs in the stapler section provided with the stapler H of the sheet processing apparatus 300 with such a structure according to a second embodiment of the present invention and the stapler H is broken down will now be described.

In this case, the user rotates the stapler H located in the staple operating position about the shaft 506 directly manually from the user access side as shown in FIGS. 10A and 12A, and moves the stapler H to the removal position shown in FIGS. 10B and 12B.

Incidentally, although the stapler H is held in the staple operating position with a constant force by the latch mechanism (not shown) when the stapler H is in the staple operating position, the holding force of the latch mechanism is released when the stapler H is rotated manually and moved from the staple operating position.

On the other hand, thereafter, when the stapler H is rotated to the removal position, a claw portion 601 that is a shaft member including a rotary center shaft 506 (see FIG. 8) projecting from the top surface of the staple cover 505 received in the sheet processing apparatus body as shown in FIG. 10A is exposed as shown in FIG. 10B.

In this case, the claw portion 601 elastically engage the rotary center shaft 506 with the sheet processing apparatus body 300D to form a holding means for holding the stapler H to the sheet processing apparatus body 300D. Then, when the stapler H is moved to the removal position where the stapler H may be removed, the claw portion 601 is moved to the position where the elastic engagement with the sheet processing apparatus body 300D is released and the stapler H may be removed, i.e., the exposed position shown in FIG. 10B.

Figure 14A:
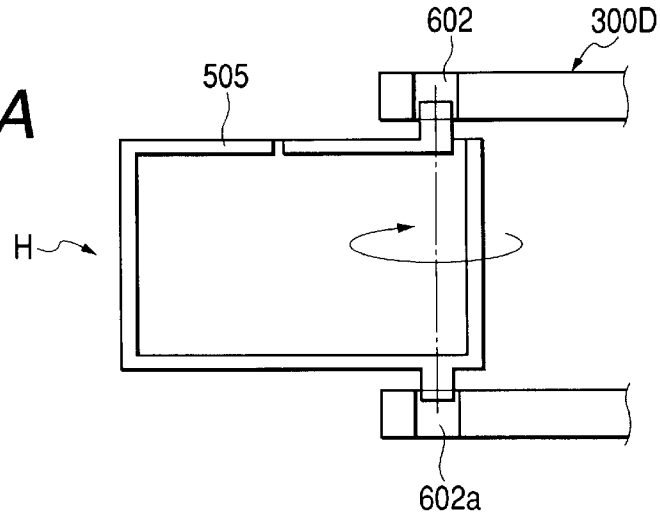
FIGS. 14A, 14B and 14C are views showing a procedure for removing the stapler.
Figure 14B:
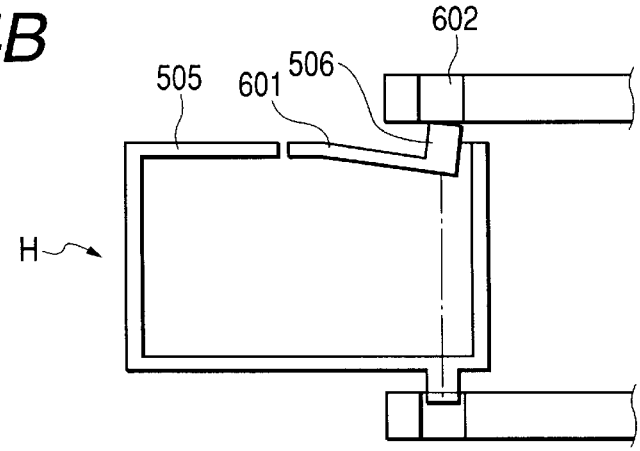
Figure 14C:
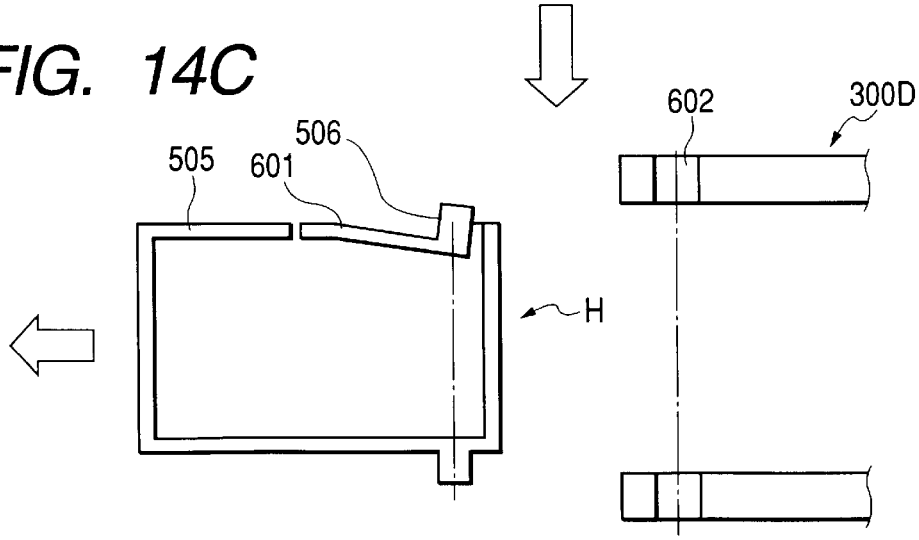

Incidentally, FIGS. 14A to 14C are views showing a procedure for removing the stapler H kept in the condition that the stapler H is rotated to the removal position. In the case where the stapler H is to be removed, first of all, the claw portion 601 that has been rotated together with the stapler H (staple cover 505) as shown in FIG. 14A and exposed is depressed from above.

In this case, the claw portion 601 may be flexed downwardly. When the claw portion is thus depressed from above, the claw portion 601 is flexed downwardly as shown in FIG. 14B. Thus, the rotary center shaft 506 may be removed from an upper shaft hole 602 formed in the sheet processing apparatus body 300D.

Then, after the rotary center shaft 506 has been thus drawn out of the upper shaft hole 602, the stapler H may be removed from the sheet processing apparatus body 300D by drawing the stapler H in the direction indicated by the arrow of FIG. 14C.

Thus, the stapler H is provided detachably from the sheet processing apparatus body 300D and movably between the staple operating position where the sheet bundle is to be bundled and the removal position. On the other hand, the stapler H is held detachably to the sheet processing apparatus body 300D by the claw portion 601 including the rotary center shaft 506. Furthermore, when the stapler H is moved to the removal position, the claw portion 601 is operated so that the stapler H may be removed. It is thus possible to readily remove the stapler H.

Incidentally, in this embodiment, in the staple operating position shown in FIG. 10A and FIG. 12A, the claw 601 is covered in the interior of the sheet processing apparatus body. Normally, the claw portion 601 is thus covered in the sheet processing apparatus body to thereby make it possible to enhance the outer appearance of the sheet processing apparatus body 300.

Figure 15A:
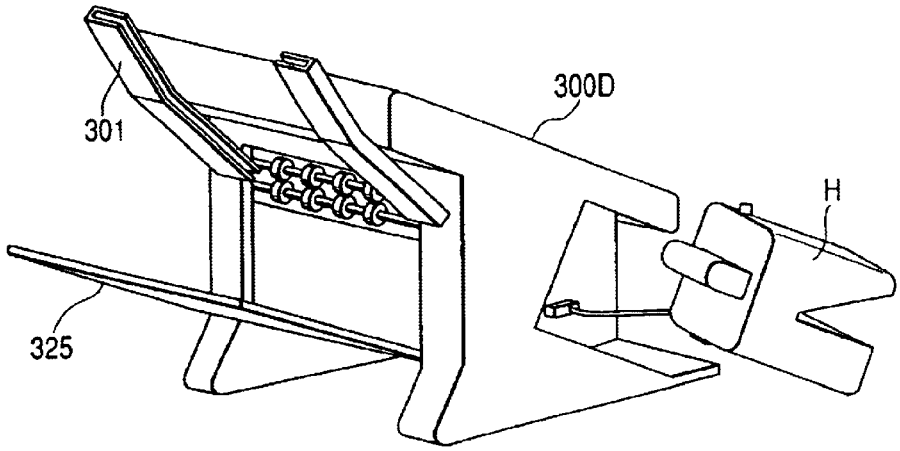
FIGS. 15A and 15B are views showing a procedure after the stapler has been removed from the sheet processing apparatus.
Figure 15B:
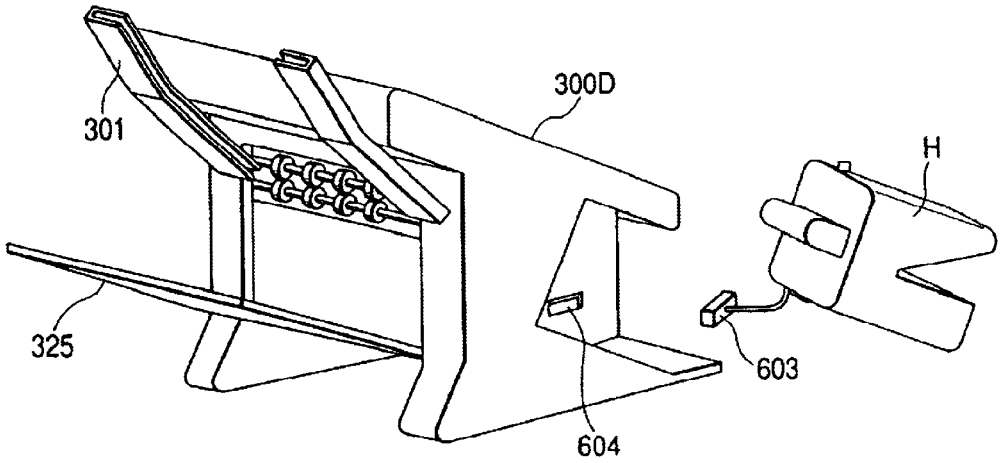

Also, this stapler H is provided with a cable connector 603 that is electrically connected to the connector 604 on the body side provided in the sheet processing apparatus body 300D. Then, after the stapler H has been removed, the cable connector 603 extending from the side of the stapler H that is kept in the connected condition as shown in FIG. 15A and the connector 604 on the side of the sheet processing apparatus body are removed as shown in FIG. 15B.

By the way, in the sheet processing apparatus 300 with such a structure, a jam processing cover 508 for jam process in the conveyer section as shown in FIG. 13 is provided. When the jam process is performed, this jam processing cover 508 is opened.

However, in the case where the staple cover 505 serves also as the outer shell of the sheet processing apparatus body 300D, when the jam processing cover 508 is thus opened, since the stapling section of the stapler H is exposed, it is desirable to disable the operation of the stapler H when the jam processing cover 508 is opened. Also, even if the stapler H is moved to the removal position as described above, since the stapling section is exposed, it is also preferable to disable the operation of the stapler.

A third embodiment of the present invention will now be described in which when the jam processing cover 508 is thus opened or the stapler H is moved to the rotational position, the stapler H is not operated.

Figure 16:
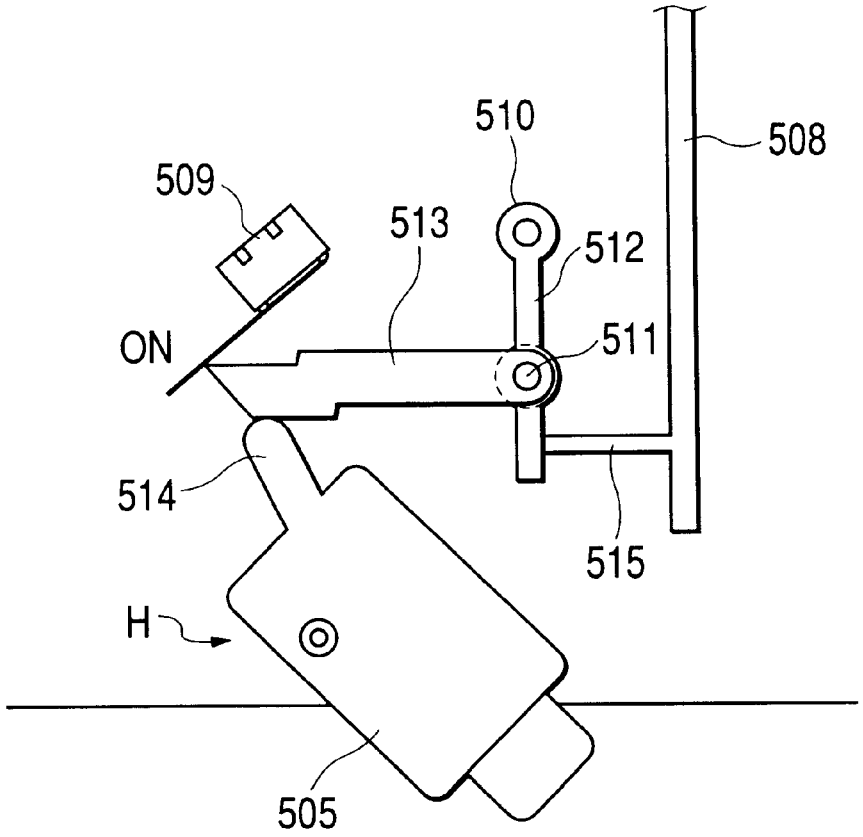
FIG. 16 is a view showing a structure of a stapler section of a sheet processing apparatus according to a third embodiment of the present invention.

FIG. 16 is a view showing a structure of the stapler section of the sheet processing apparatus according to this embodiment.

In FIG. 16, reference numeral 509 denotes an operation controlling switch for controlling the operation of the stapler H, reference numeral 512 denotes a rotatable link that is rotatable about a shaft 510, and reference numeral 513 denotes a link lever rotatably held through a shaft 511 to the link 512. Also, reference numeral 514 denotes a switch lever provided on the staple cover 505 of the stapler H and reference numeral 515 denotes a switch lever provided on a jam processing cover 508.

Incidentally, the link 512 is biased in pressing contact with the switch lever 515 provided on the jam processing cover 508 by biasing means (not shown). Also, the link lever 513 is biased and brought into pressing contact with the switch lever 514 of the stapler H by the biasing means (not shown).

By the way, FIG. 16 shows a condition that the stapler H is located in the staple operating position. In this condition, the jam processing cover 508 is closed. At this time, the link lever 513 is depressed by the switch lever 514 of the stapler H so that the operating controlling switch 509 is turned on. Thus, the stapler H is kept in the operable condition.

Figure 17A:
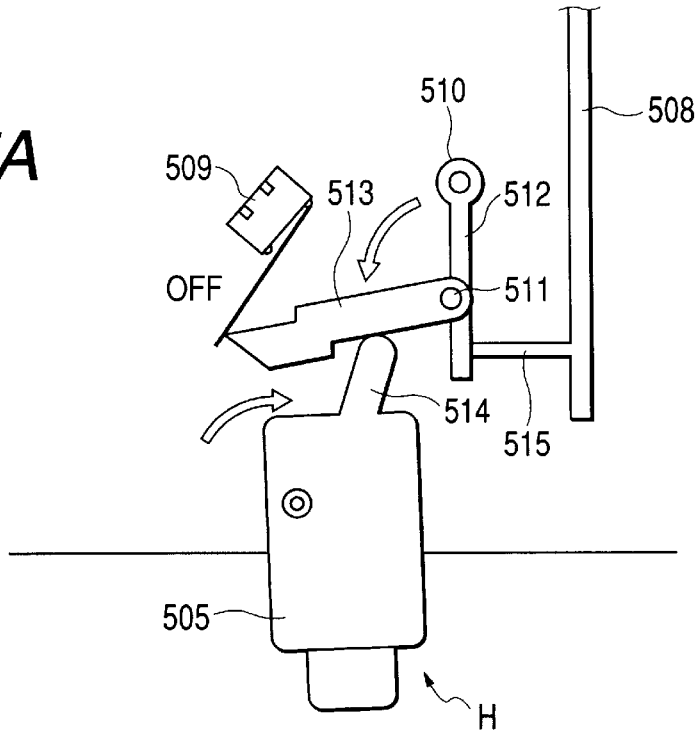
FIG. 17A is a view showing a condition of the stapler section in which a stapler is moved to the rotary position.

On the other hand, FIG. 17A shows a condition of the stapler section when the stapler H is moved from the staple operating position to the rotational position. Under this condition, the link lever 513 depressed by the switch lever 514 of the stapler H is rotated in the direction indicated by the arrow around the shaft 511 by the biasing means (not shown). As a result, the operation controlling switch 509 is turned off and the stapler H is in an inoperative condition. Accordingly, even if the stapling section in the rotational position is exposed to the outside, the stapler H is no longer operated.

Figure 17B:
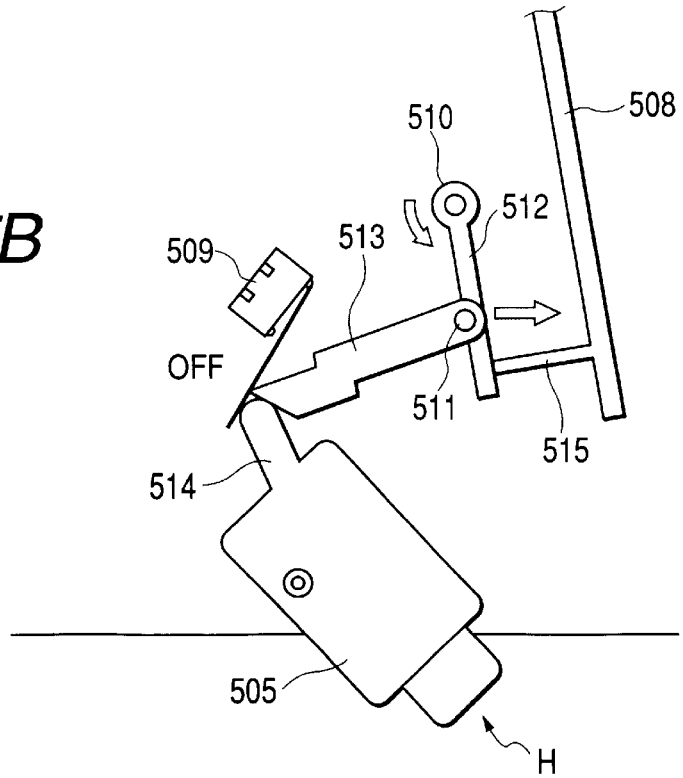
FIG. 17B is a view showing a condition of the stapler section in which a jam processing cover is opened.

Also, FIG. 17B shows a condition in which the jam process cover 508 is opened. The link 512 depressed by the switch lever 515 of the jam process cover 508 in this condition is rotated about the shaft 510 so that the shaft 511 is moved in the direction indicated by the arrow.

Then, when the shaft 511 is thus moved, the link lever 513 is separated away from the operation controlling switch 509, as a result of which the operation controlling switch 509 is turned off and the stapler H is in the inoperative condition. Accordingly, the stapler H is no longer operated even under the condition that the jam process cover 508 is opened and the stapling section is exposed to the outside.

A fourth embodiment of the present invention will now be described.

Figure 18A:
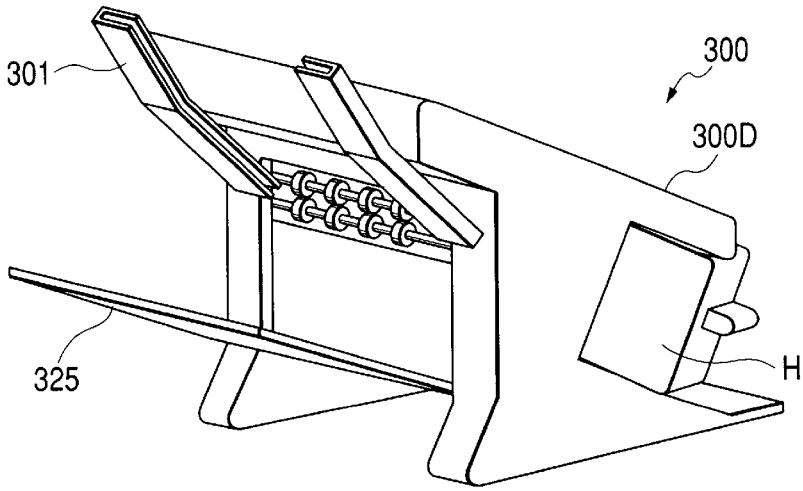
FIGS. 18A and 18B are perspective views showing a sheet processing apparatus in accordance with a fourth embodiment of the present invention.
Figure 18B:
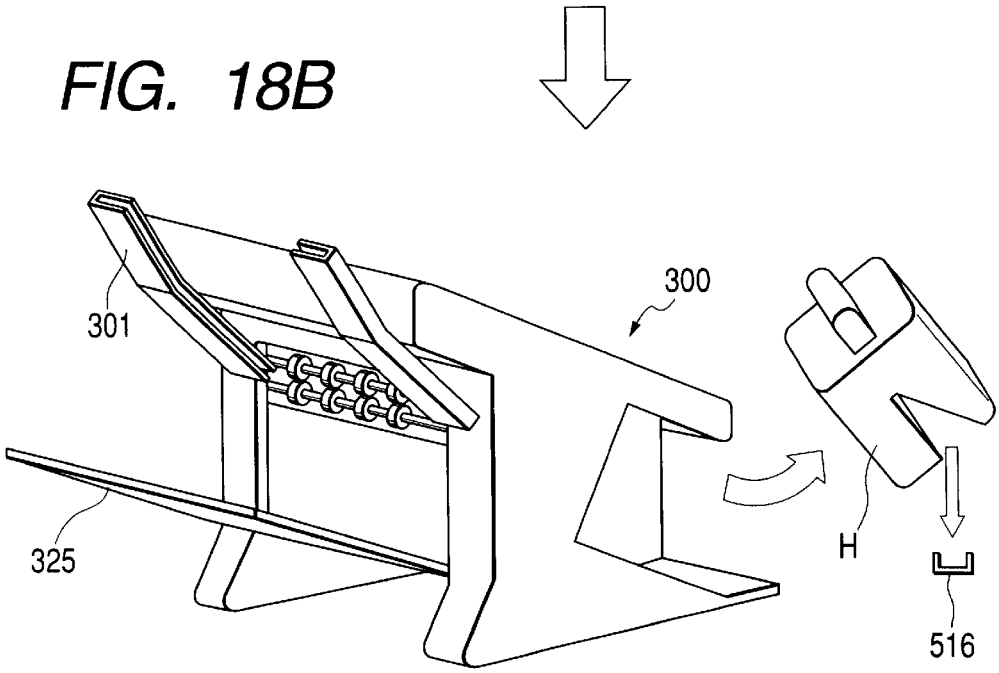

FIGS. 18A and 18B are perspective views showing the sheet processing apparatus according to this embodiment. Incidentally, in FIGS. 18A and 18B, the same reference numerals are used to indicate the corresponding parts or members as those of FIGS. 12A and 12B.

In this embodiment, when the staples of the stapler H are expended, the user may directly remove the stapler H, located in the staple operating position as shown in FIG. 18A, from the sheet processing body 300D as shown in FIG. 18B. Incidentally, the stapler H is normally held with a constant force by the latch mechanism (not shown) in the staple operating position. However, when the stapler is moved from the staple operating position manually, the holding force may be released.

Thus, the stapler H is removed to the outside so that the user may readily draw the staple cartridge removal knob 507 and may perform the replacement of the staple cartridges. Furthermore, as shown in FIG. 18B, the stapler H (of which stapling section) is provided in the lower portion whereby the staples 516 accumulated in the stapling section after the idle strike during the jam condition may readily be removed.

Figure 19:
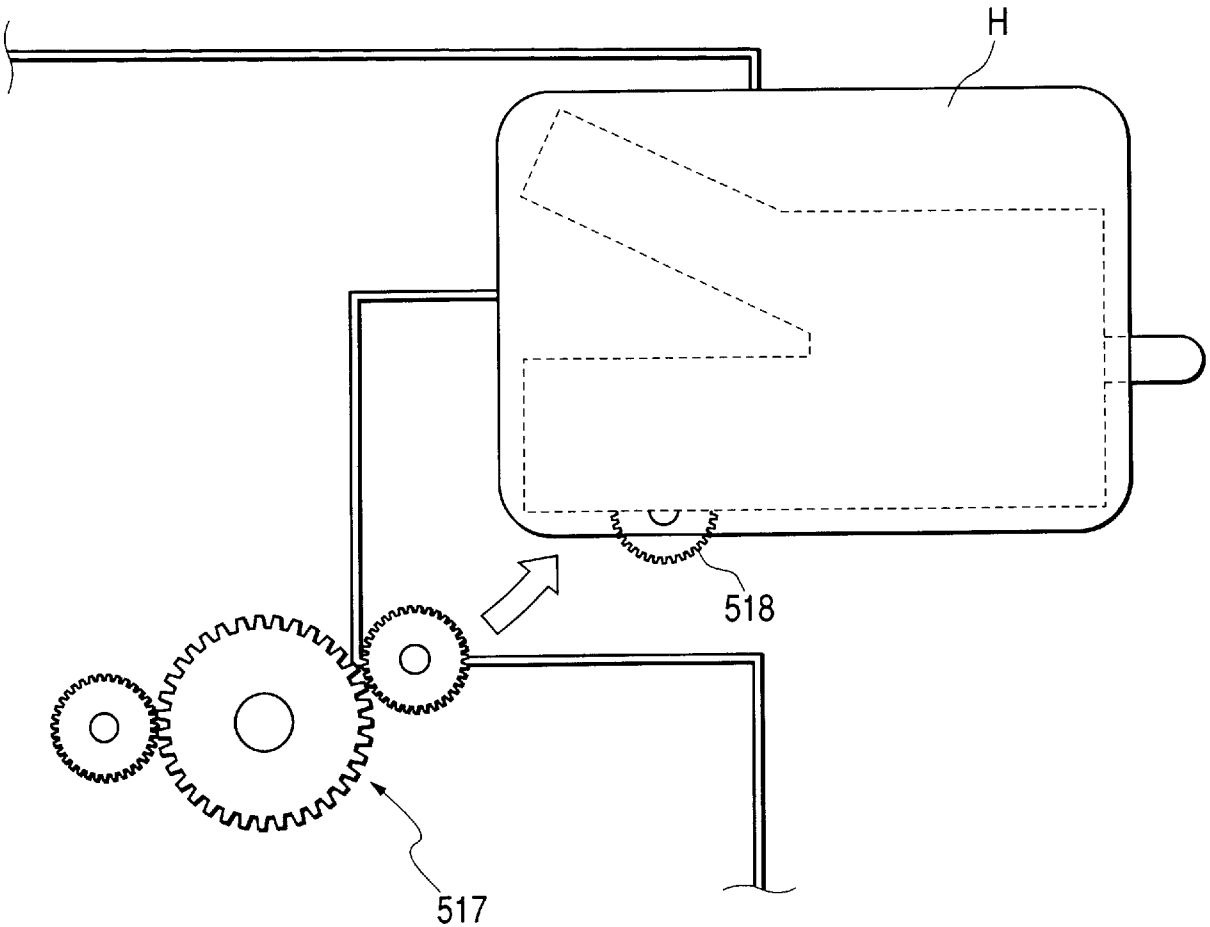
FIG. 19 is a view showing a structure of a driver section of the stapler provided in the sheet processing apparatus.

Also, in the stapler H in accordance with this embodiment, in the staple operating position as shown in FIG. 19, a gear train 517 in cooperation with a drive source of the sheet processing apparatus body 300D and a gear 518 provided in the stapler H are engaged with each other. When the stapler H is removed from the sheet processing apparatus body 300D, the engagement between the gear train 517 and the gear 518 is released so that the stapler H is not subjected to the drive.

Then, when the stapler H is thus removed from the sheet processing apparatus body 300D, the transmission of the drive is disabled whereby when the stapler H is removed, even if the stapling section is exposed to the outside, the stapler H is no longer operated.

A fifth embodiment of the present invention will now be described.

Figure 20A:
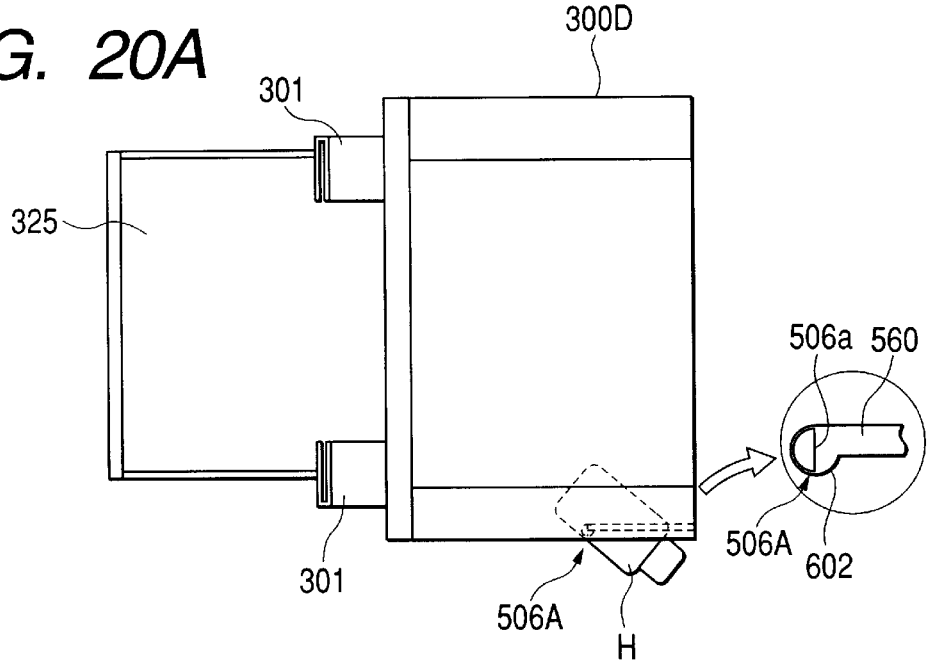
FIGS. 20A and 20B are views showing a rotational operation a stapler in a sheet processing apparatus in accordance with a fifth embodiment of the present invention.
Figure 20B:
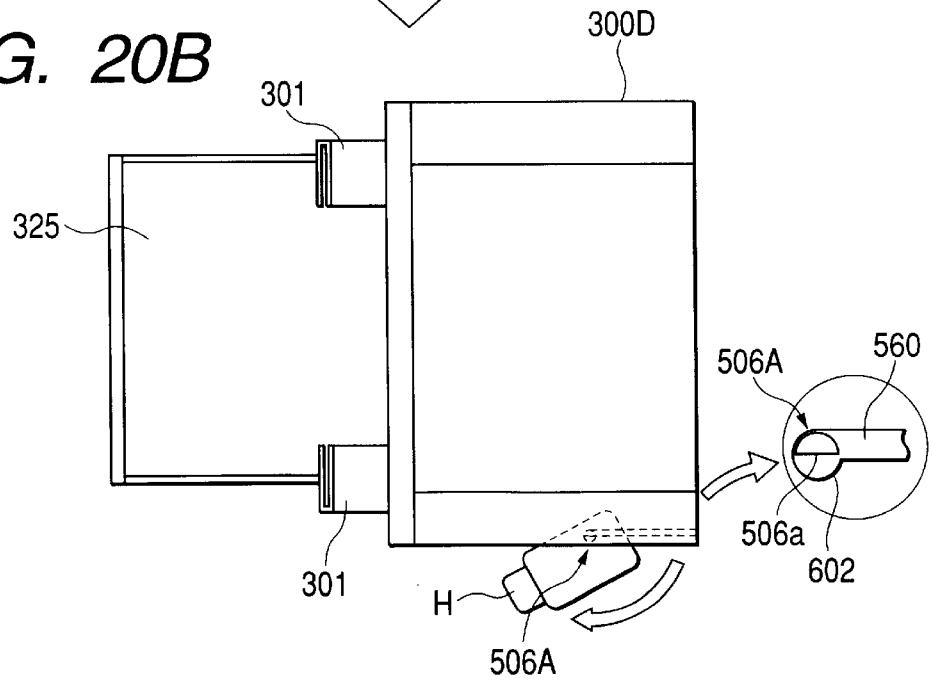

FIGS. 20A and 20B are views showing a structure of a stapler section of a sheet processing apparatus in accordance with this embodiment. Incidentally, in FIGS. 20A and 20B, the same reference numerals are used to indicate the corresponding parts and members as those of FIGS. 10A and 10B.

In FIGS. 20A and 20B, reference numeral 506A denotes the rotary center shaft of the stapler H forming the holding means for detachably holding the stapler H to the sheet processing apparatus body 300D as desired. For example, a cutaway portion 506*a* having a D-cut shape is formed in the upper end portion of the rotary center shaft 506A of the stapler H. Also, reference numeral 560 denotes a mounting groove that is a mounting guide section for guiding the stapler H to an upper shaft hole 602 and a lower shaft hole 602*a* (see FIGS. 14A to 14C) formed in a predetermined holding position of the sheet processing apparatus body 300D. During the mounting operation, the rotary center shaft 506A of the stapler H is guided to the upper shaft hole 602 and the lower shaft hole 602*a* along the mounting groove 560.

In this case, the width of this mounting groove 560 is narrower than a diameter of the rotary center shaft 506. When the stapler H is in the staple operating position, a cutaway portion 506*a* that is cut away so as to be greater than the width of the mounting groove 560 as shown in FIG. 20A faces the mounting groove 560. Then, under this condition since the rotary center shaft 506 is no longer introduced into the mounting groove 560, the stapler H could not be drawn out.

On the other hand, in the case where the staple clogging takes place in the stapler H or the stapler H is broken down, the user directly manually rotate the stapler H from the staple operating position shown in FIG. 20A to the removal position shown in FIG. 20B about the rotation center shaft 506.

Then, when the stapler H is removed and rotated to the removal position, the cutaway portion 506*a* of the rotary center shaft 506 is directed to the condition that the cutaway portion may be introduced into the mounting groove 560 as shown in FIG. 20B. Incidentally, the stapler H is held with a constant force by the latch mechanism (not shown) in the staple operating position shown in FIG. 20A. The stapler H may be rotated manually and when the stapler is moved from the staple operating position, the holding force is released.

Figure 21A:
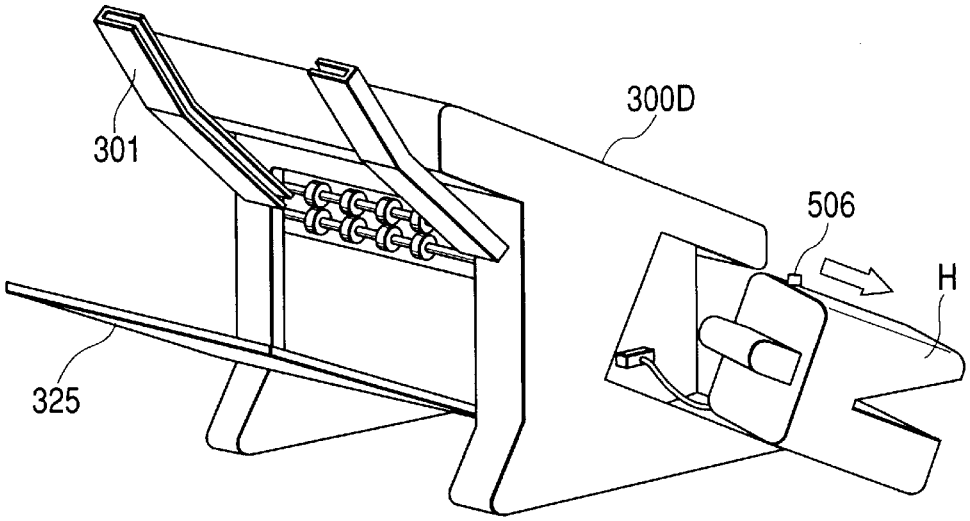
FIGS. 21A and 21B are views showing the operation for removing the stapler.
Figure 21B:
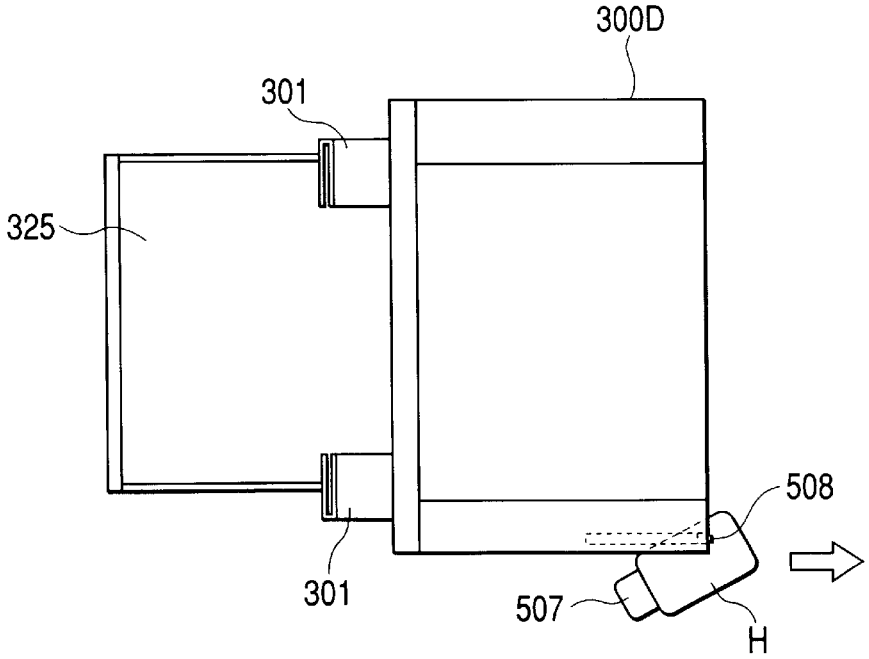

Then, after the cutaway portion 506*a* is brought into such a direction, the stapler H is slid so as to be along the mounting groove 560 as shown in FIGS. 21A and 21B, the stapler H may be removed from the sheet processing apparatus body 300D.

Thus, when the stapler H is moved to the removal position, the stapler H is adapted to be operated and removed from the sheet processing apparatus body 300D along the mounting groove 560 so that the stapler H may readily be removed to the outside.

By the way, in this embodiment, the connector 604 on the side of the sheet processing apparatus body connected to the cable connector 603 of the stapler H is fixed at one end to the sheet processing apparatus interior and is mounted on the cable that may be drawn. Thus, when the stapler H is removed from the sheet processing apparatus body 300D, the connector 604 on the apparatus body side is also drawn out to the outside together with the stapler H.

Figure 22A:
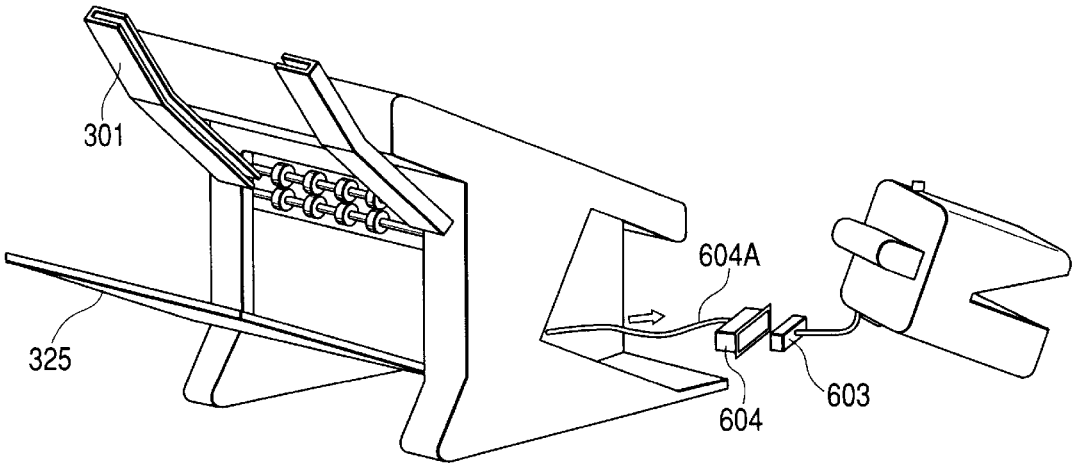
FIGS. 22A and 22B are views showing a procedure after the stapler has been removed away from the sheet processing apparatus body.
Figure 22B:
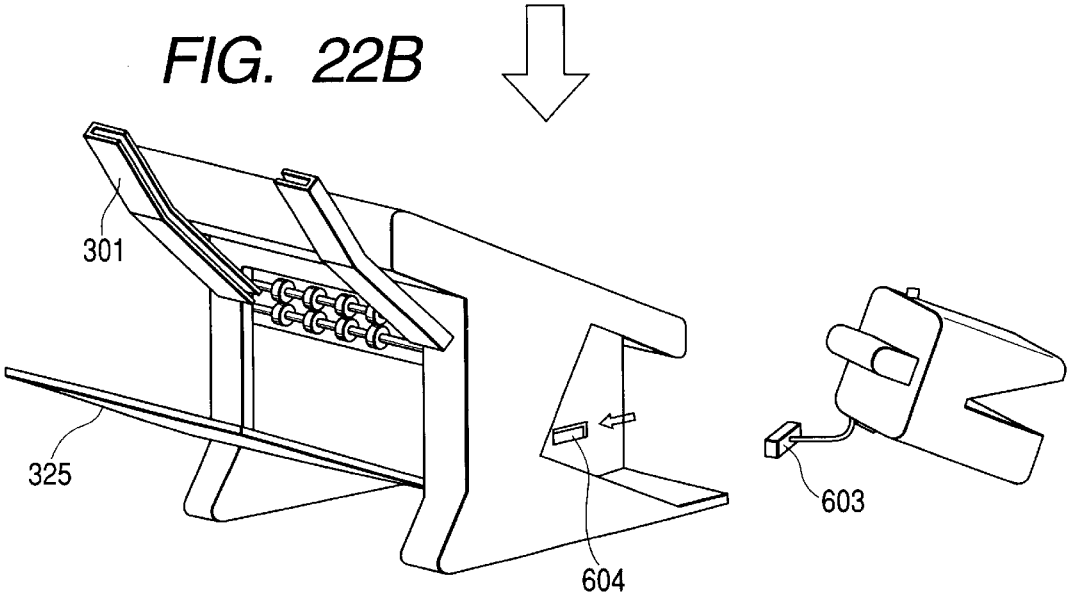

Incidentally, after the stapler H has been thus removed, when the connectors 603 and 604 connected to each other are separated as shown in FIG. 22A, the connector 604 on the apparatus body side is returned to the original portion as shown in FIG. 22B by the retracting force of the retracting means (not shown) for the cable 604A into the apparatus body interior.

Then, the connector 604 on the sheet processing apparatus body side may be thus retracted to the outside so that the operationability of the connecting/disconnecting of the connectors 603 and 604 may be enhanced upon the mounting/detaching of the stapler H.

Incidentally, in the sheet processing apparatus according to this embodiment, the jam process cover 508 is provided as shown in FIG. 13 described above for the jam process in the conveyer section. Also, when the jam process cover 508 is opened during the jam process, or even under the condition that the stapling section of the stapler H is exposed to the outside, the operation limiting mechanism as shown in FIG. 16 described above is provided so that the sheet processing apparatus body is inoperative.

Furthermore, in the embodiment, during the replacement of the staplers, when the stapler is removed, the sheet processing apparatus body 300D is inoperative. However, after the stapler H has been removed as described above, if the connector 603 is removed, the link lever 513 shown in FIG. 16 is adapted to be returned to the same condition as the case where the link lever 513 is pushed by the switch lever 514 shown in FIG. 16 by the retracting means (not shown) for retracting the cable 604A into the interior of the apparatus.

Thus, the sheet processing apparatus body 300D is operative, as a result of which even if the stapler H is removed, as descried above, after the alignment by the alignment means 301 has been performed, the stack mode is possible in which the sheet is discharged and stacked onto the second stacking section 325 simply in a face down manner.

A sixth embodiment of the present invention will now be described.

Figure 23A:
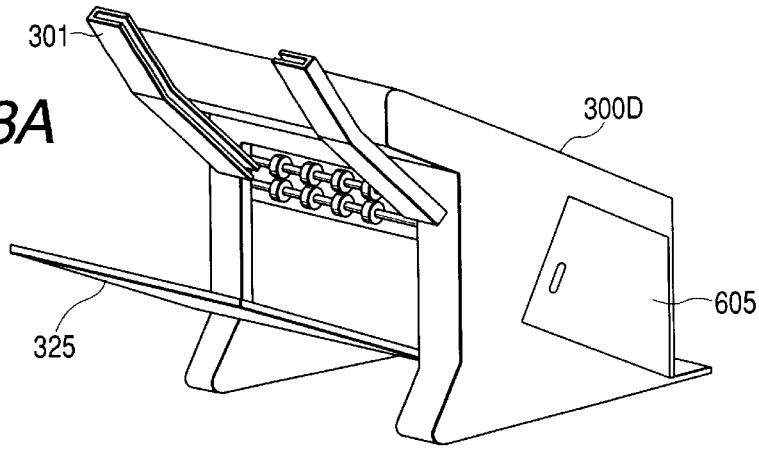
FIGS. 23A, 23B and 23C are views showing a stapler removal operation in a sheet processing apparatus in accordance with a sixth embodiment of the present invention.
Figure 23B:
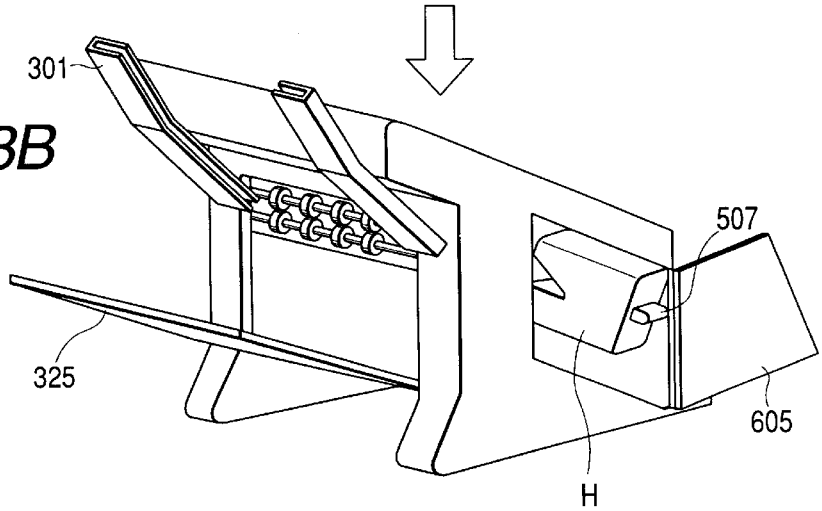
Figure 23C:
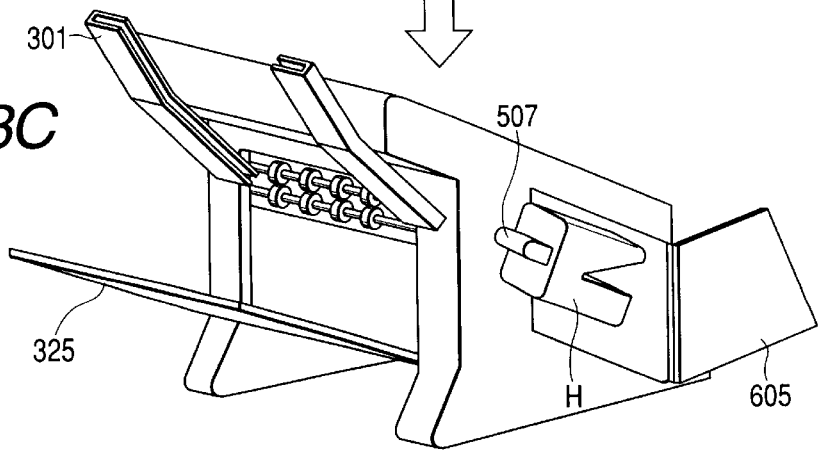

FIGS. 23A to 23C are views illustrating the stapler removal operation in the sheet processing apparatus in accordance with this embodiment.

Incidentally, in this embodiment, the stapler H is disposed in the interior of the outer shell whereby the design of the outer appearance of the sheet processing apparatus body 300D is enhanced.

Then, in such a sheet processing apparatus, when the staple clogging occurs in the stapler H arranged in the interior in the outer shell or the stapler H is broken down, first of all, the user opens an outer shell door 605. Subsequently, the stapler H arranged in the interior is directly manually rotated from the staple operating position shown in FIG. 23B to the removal position shown in FIG. 23C.

In this case, when the stapler H is thus rotated to the removal position, the claw portion 601 including the rotary center shaft 506 as shown in FIGS. 10A and 10B as described above is exposed to the outside. Incidentally, the stapler H is held with a constant force by the latch mechanism (not shown) in the staple operating position. However, if the stapler is moved from the staple operation position, the holding force is released.

Subsequently, when the claw portion 601 is depressed from above from this condition, the claw portion 601 is flexed downwardly as shown in FIG. 14B whereby the rotary center shaft 506 may be removed from the upper shaft hole 602 formed in the sheet processing apparatus body 300D.

Figure 24A:
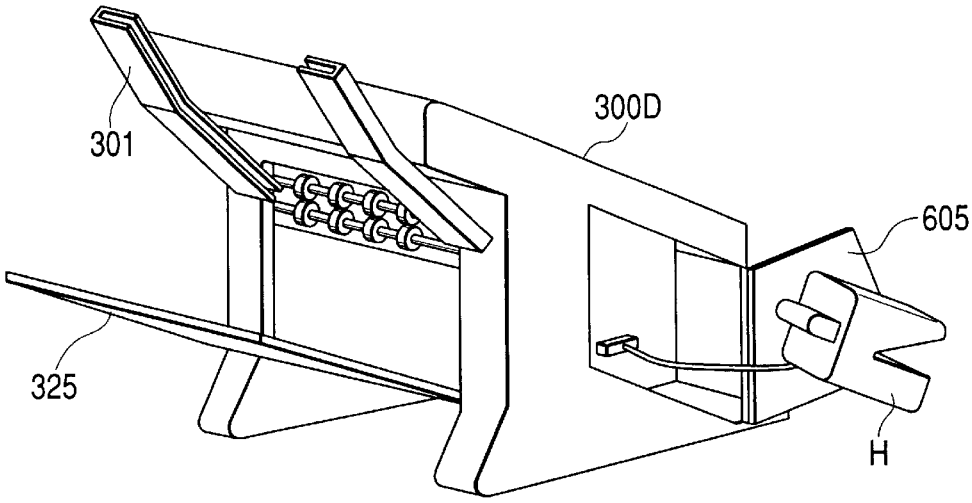
FIGS. 24A and 24B are views showing a procedure after a stapler has been removed away from the sheet processing apparatus.
Figure 24B:
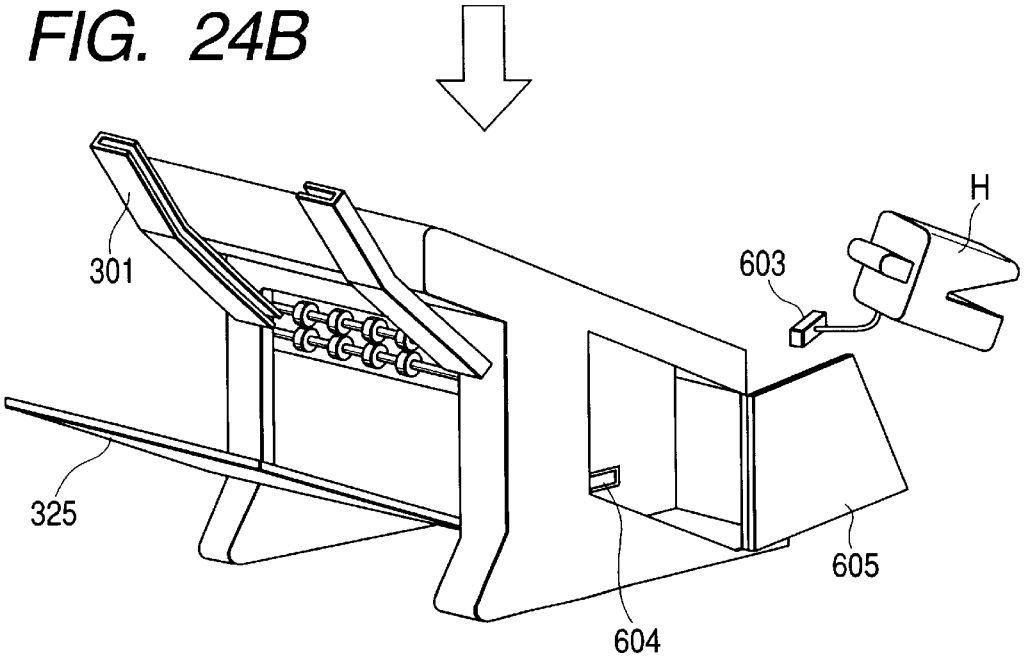

Incidentally, after the stapler H has been thus removed, the cable connector 603 extending from the side of the stapler H kept under the connected condition shown in FIG. 24A and the connector 604 on the side of the sheet processing apparatus body are removed as shown in FIG. 24B.

What is claimed is:

1. A sheet processing apparatus provided with a stapler for performing a stapling process on a sheet bundle, said stapler comprising a detachably mountable staple cartridge, and a cover that forms an outer appearance of said stapler and serves also as an outer shell of said sheet processing apparatus, said stapler being provided in an apparatus body and being selectively movably between a stapling position for stapling the sheet bundle and a position for replacing the staple cartridge, wherein said stapler is detachably mounted on said apparatus body and provided movably to a position where said stapler is removable; and holding means provided in said stapler for holding said stapler detachably to said apparatus body, wherein said holding means is in the condition that said stapler may be removed from the apparatus body when said stapler is moved to the position where said stapler is removable, and wherein said holding means is a shaft member that is engaged elastically with said apparatus body for holding said stapler and that, when said holding means is moved to the position where said stapler is removable; said holding means is operable to release the elastic engagement with said apparatus body and to move to the position where the stapler is removable.

2. A sheet processing apparatus according to claim 1, wherein said shaft member is provided in a position where said shaft member is not visible from the outside until said stapler is moved to the removable position.

3. A sheet processing apparatus according to claim 1, further comprising mounting guide section for guiding said stapler to a predetermined held position of said apparatus body, wherein said holding means is a shaft for guiding said stapler along said mounting guide section to the predetermined held position and for pivotally supporting said stapler movably between the position for stapling the sheet bundle and the removable position in the predetermined held position and is operable to remove said stapler along said mounting guide section from said apparatus body when said stapler is moved to the removable position.

4. A sheet processing apparatus according to claim 3, wherein a cutaway portion if formed for removing said stapler away from said apparatus body along said mounting guide section when said stapler is moved to the removable position.

5. A sheet processing apparatus according to any one of claims 1 to 4, wherein a jam process cover is provided and, in the case where the jam process cover is opened or in the case where said stapler is not in the stapling position for stapling the sheet bundle, said stapler is inoperative.

6. A sheet processing apparatus according to claim 1, wherein said stapler and said apparatus body are connected to each other through an electric cable connector, and a connector for said stapler and a connector for said apparatus body are detachably mountable.

7. A sheet processing apparatus according to claim 6, wherein said stapler is provided with a connector connected to the connector on the side of said apparatus body and provided retractably to said apparatus body, and said stapler is removed while drawing the connector on side of said apparatus body when said stapler is to be removed.

8. A sheet processing apparatus according to claim 7, further comprising return means for returning said connector on the side of said body removed from said stapler to said apparatus body after said stapler has been removed.

9. A sheet processing apparatus according to claim 8, further comprising a sheet stacking section for stacking the sheet bundle to which the stapling process is performed, and alignment means for performing alignment of the sheet stacked on said sheet stacking section, wherein the alignment operation is possible by said alignment means when said apparatus body side connector is removed from said stapler that has been removed.

10. An image forming apparatus provided with an image forming section and a sheet processing apparatus for performing a stapling process to a sheet on which an image is formed by said image forming section, wherein said sheet processing apparatus is in accordance with any one of claims 1 to 4 and 6 to 9.

11. An image forming apparatus provided with an image forming section and a sheet processing apparatus for performing a stapling process to a sheet on which an image is formed by said image forming section, wherein said sheet processing apparatus is in accordance with any one of claims 1 to 4 and 6 to 9 and is disposed above said apparatus body.

12. An image forming apparatus provided with an image forming section and a sheet processing apparatus for performing stapling process to a sheet on which an image is formed by said image forming section, wherein said sheet processing apparatus is in accordance with any one of claims 1 to 4 and claims 6 to 9 and is provided with a paper feed cassette received detachably in said apparatus body and an operation section provided in said apparatus body, and wherein a sheet conveying direction in said stapler of said sheet processing apparatus and any one of a mounting direction of said paper feed cassette and a direction toward said operation section are the same.

13. An image forming apparatus provided with an image forming section and a sheet processing apparatus for performing a stapling process to a sheet on which an image is formed by said image forming section, wherein said sheet processing apparatus is in accordance with any one of claims 1 to 4 and 6 to 9 and said sheet processing apparatus has a first sheet stacking section for stacking tentatively the sheet on which an image is formed by said image forming section and an alignment means for performing the alignment of the sheet stacked on said first sheet stacking section.

14. An image forming apparatus provided with an image forming section and a sheet processing apparatus for performing stapling process to a sheet on which an image is formed by said image forming section, wherein said sheet processing apparatus is in accordance with claim 1, and said stapler is provided with a staple cartridge removal knob for removing said staple cartridge, and wherein said staple cartridge removal knob is visually observable in any one of a mounting direction of said paper feed cassette and a direction toward an operation section.

* * * * *

UNITED STATES PATENT AND TRADEMARK OFFICE

CERTIFICATE OF CORRECTION

PATENT NO. : 6,661,995 B2
DATED : December 9, 2003
INVENTOR(S) : Kenichiro Isobe et al.

It is certified that error appears in the above-identified patent and that said Letters Patent is hereby corrected as shown below:

Column 4,
Line 2, “a”should read -- an --.

Column 5,
Line 53, “a” should read -- an --.

Column 10,
Line 25, “arrows” should read -- arrow --.

Column 17,
Line 8, “descried” should read -- described --.
Line 57, “movably” should read -- movable --.

Column 18,
Line 27, “if” should read -- is --.
Line 45, “side” should read -- the side --.

Signed and Sealed this

Twenty-second Day of June, 2004

JON W. DUDAS
*Acting Director of the United States Patent and Trademark Office*